US006888557B2

(12) United States Patent
Inoue et al.

(10) Patent No.: US 6,888,557 B2
(45) Date of Patent: May 3, 2005

(54) ELECTROLUMINESCENT DEVICE WITH SUFFICIENT LUMINOUS POWER AND DRIVING METHOD THEREOF

(75) Inventors: Takashi Inoue, Kuwana-gun (JP); Masayuki Katayama, Handa (JP); Yutaka Hattori, Okazaki (JP); Hirotaka Suzuki, Toyota (JP); Masahiko Osada, Hekinan (JP); Yasuo Yamamoto, Handa (JP); Tomoya Uchida, Kariya (JP)

(73) Assignee: Denso Corporation, Kariya (JP)

( * ) Notice: Subject to any disclaimer, the term of this patent is extended or adjusted under 35 U.S.C. 154(b) by 71 days.

(21) Appl. No.: 10/367,800

(22) Filed: Feb. 19, 2003

(65) Prior Publication Data

US 2003/0174199 A1 Sep. 18, 2003

(30) Foreign Application Priority Data

Mar. 15, 2002 (JP) ..... 2002-072220
Mar. 15, 2002 (JP) ..... 2002-072274
Sep. 3, 2002 (JP) ..... 2002-257668

(51) Int. Cl.[7] ..... B41J 2/447; G09G 3/12

(52) U.S. Cl. ..... 347/238; 347/247; 347/372; 315/169.3

(58) Field of Search ..... 347/237, 238, 347/247; 362/84; 313/498, 503, 505, 506; 315/169.3

(56) References Cited

U.S. PATENT DOCUMENTS 5,216,331 A * 6/1993 Hosokawa et al. ..... 315/169.3
5,325,277 A * 6/1994 Suzuki et al. ..... 362/84
5,847,516 A * 12/1998 Kishita et al. ..... 315/169.3
2001/0052926 A1 * 12/2001 Hori ..... 347/238

FOREIGN PATENT DOCUMENTS

JP A-05-221019 8/1993
JP A-9-54566 2/1997

OTHER PUBLICATIONS

Tanaka et al., "Excitation Mechanism in Red Cas:Eu and Blue SrS:Ce, K Thin Film Electroluminescent Devices," *Japan Display*, 1986, pp. 242–245.

Tuenge et al., "A QVGA AMEL Microdisplay with Improved Color Performance," *Asia Display*, IDW, 2001, pp. 1071–1074.

* cited by examiner

*Primary Examiner*—Huan Tran
(74) *Attorney, Agent, or Firm*—Posz & Bethards, PLC

(57) ABSTRACT

An EL device includes a control unit that controls a driving circuit so that a plurality of EL elements emits light several times per driving cycle. Specifically, when a driving voltage is applied to the plurality of EL elements, the plurality of EL elements emits several times per driving cycle. As a result, since the amount of light integrated per time increases, the plurality of EL elements obtains high luminous power even if a plurality of El elements having a very short emission decay time is used.

65 Claims, 18 Drawing Sheets

ELECTROLUMINESCENT DEVICE WITH SUFFICIENT LUMINOUS POWER AND DRIVING METHOD THEREOF

CROSS REFERENCE TO RELATED APPLICATIONS

This application is based upon and claims the benefit of Japanese Patent Application No. 2002-072220 filed on Mar. 15, 2002, No. 2002-072274 filed on Mar. 15, 2002 and No. 2002-257668 filed on Sep. 3, 2002, the contents of which are incorporated herein by reference.

FIELD OF THE INVENTION

The present invention relates generally to electroluminescent (EL) devices with EL elements having an short emission decay time and driving method thereof.

BACKGROUND OF THE INVENTION

JP-A-9-54566 discloses a display with EL elements having a phosphor made of ZnS:Mn. However, such El elements only emit an umber color light so that the EL device cannot be used as a display. Accordingly, other displays with EL elements emitting other colors are now being developed.

As for printer technology, a printer head having LEDs as a light source is used for an LED printer. However, because light emitted from respective LEDs is imbalanced, the printing quality of the printer is not good. Accordingly, JP-A-5-221019 discloses a printer head having EL elements having a phosphor made of ZnS:Mn.

Regarding the EL elements having the phosphor made of ZnS:Mn, an emission decay time of the phosphor is several seconds longer than an emission rise time thereof because the emission rise time is several microseconds as shown in FIG. 25. As a result, print dots extend in a direction parallel to a paper transmission direction when printing speed increases.

FIG. 26A illustrates an exemplary circular dot and an elliptical dot extended due to high printing speed, and FIG. 26B illustrates dots when a plurality of circular dots and a plurality of elliptical dots are printed at intervals of one dot. As shown in FIG. 26B, the elliptical dots overlap one another when respective dots are printed with intervals corresponding to one dot. To avoid an overlap of the elliptical dots, the printing speed or resolution of the printer is consequently decreased.

To solve the problem mentioned above, a printer head with EL elements having a phosphor of which an emission decay time is shorter than that of a phosphor made of ZnS:Mn is used for a printer light source. However, the luminous power of the phosphor is not sufficient. When EL elements having such a phosphor are used for a display, the luminous power of the phosphor is also not sufficient. This is because people perceive light based on an amount of light integrated over time, and the amount of light integrated over time decreases due to a short emission decay time.

SUMMARY OF THE INVENTION

A printer head having EL elements with a phosphor made of SrS:Ce (Strontium sulfide/Cerium) may be used for a luminescent printer. Since an emission rise time and an emission decay time of the phosphor made of SrS:Ce is short on the order of microseconds, the luminescent printer can print at a high speed (e.g., Japanese patent application No. 2002-190368).

With the luminescent printer, a scanning voltage is applied to the EL elements through a scanning electrode every driving cycle. Each of the EL elements is controlled to an illumination state (ON state at which the printer head prints) and a non-illumination state (OFF state at which the printer head does not print) based on whether a data voltage is applied to each data electrode included in each of the EL elements. In the luminescent printer configured as mentioned above, about 200V is required to illuminate the EL elements for printing. A driver circuit (a data electrode driver) for applying the data voltage to the data electrodes has to include a logic circuit that determines an output of the data voltage based on a display data signal generated by an external circuit. As a result, to withstand a high surge voltage, the data electrode driver is complicated.

Further, in the luminescent printer, the scanning voltage and the data voltage are set to asymmetric voltage levels (e.g., the scanning voltage is set to 180V and the data voltage is set to 40V) because a withstand voltage of the data electrode driver is preferably set within 40V to 60V. However, a difference of the scanning voltage between a time at which the EL elements are set to an ON state and a time at which the EL elements are set to an OFF state is only about 40V, so that the EL elements slightly emit light when the EL elements are set to an OFF state.

Therefore, when the printer head having EL elements of which a phosphor is made of SrS:Ce is used in the luminescent printer, the EL elements need to be operated within a dynamic range (print constant) of the luminous power in which the luminescent printer can appropriately control printing even if the difference of the scanning voltage is only about 40V.

However, as shown in FIG. 27, the dynamic range of the EL elements having the SrS:Ce phosphor is relatively narrow while that of the EL element having the ZnS:Mn phosphor is wide when the difference of the scanning voltage is only about 40V.

It is therefore an object of the present invention to provide an EL device and driving method thereof, an EL driving device and a printer head including the EL device that are capable of obviating the above problem.

It is another object of the present invention to provide an EL device, a driving method thereof, an EL driving device and a printer head including the EL device that are capable of emitting light sufficiently when a phosphor of the EL device is made of a material by which a fall emission time can be shortened.

Accordingly, the present invention provides an EL device, a driving device for driving a plurality of EL elements and a printer head in which a control unit controls a driving circuit so that a plurality of EL elements emits light several times per driving cycle.

Therefore, when a driving voltage is applied to the plurality of EL elements, the plurality of EL elements emits light several times per driving cycle. As a result, since the amount of light integrated over time increases, the plurality of EL elements obtains high luminous power even if a plurality of El elements having a short emission decay time is used.

For example, the plurality of EL elements may include a phosphor for emitting light that includes a luminescent center material made of one of Ce and Eu. The phosphor includes a primary material made of SrS.

According to another aspect of the present invention, a method for driving an EL device and a method for driving a printer head of the present invention include applying a driving voltage to both sides of a plurality of EL elements through a control unit to cause the plurality of EL elements to emit light several times per driving cycle.

BRIEF DESCRIPTION OF THE DRAWINGS

Other objects, features and advantages of the present invention will be understood more fully from the following detailed description made with reference to the accompanying drawings. In the drawings.

DETAILED DESCRIPTION OF THE PREFERRED EMBODIMENT

Figure 1:
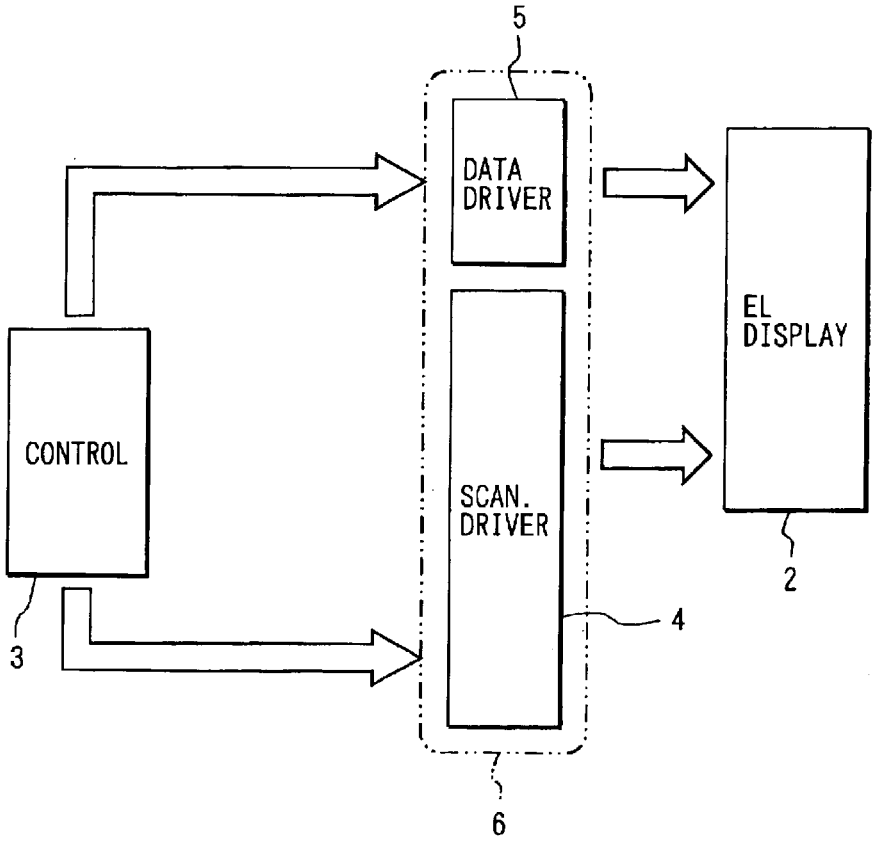
FIG. 1 shows an electrical configuration of an EL display device according to a first embodiment of the present invention.

The present invention will be described further with reference to various embodiments shown in the drawings.

(First Embodiment)

In the first embodiment, a dot matrix type EL display device (EL display device) will now be described with reference to FIGS. 1–6.

In FIG. 1, an EL display 2 is controlled by a control unit 3. Specifically, the control unit 3 outputs control signals to a scanning electrode driver (driving circuit) 4 and a data electrode driver (driving circuit) 5 to control the EL display 2.

Figure 2:
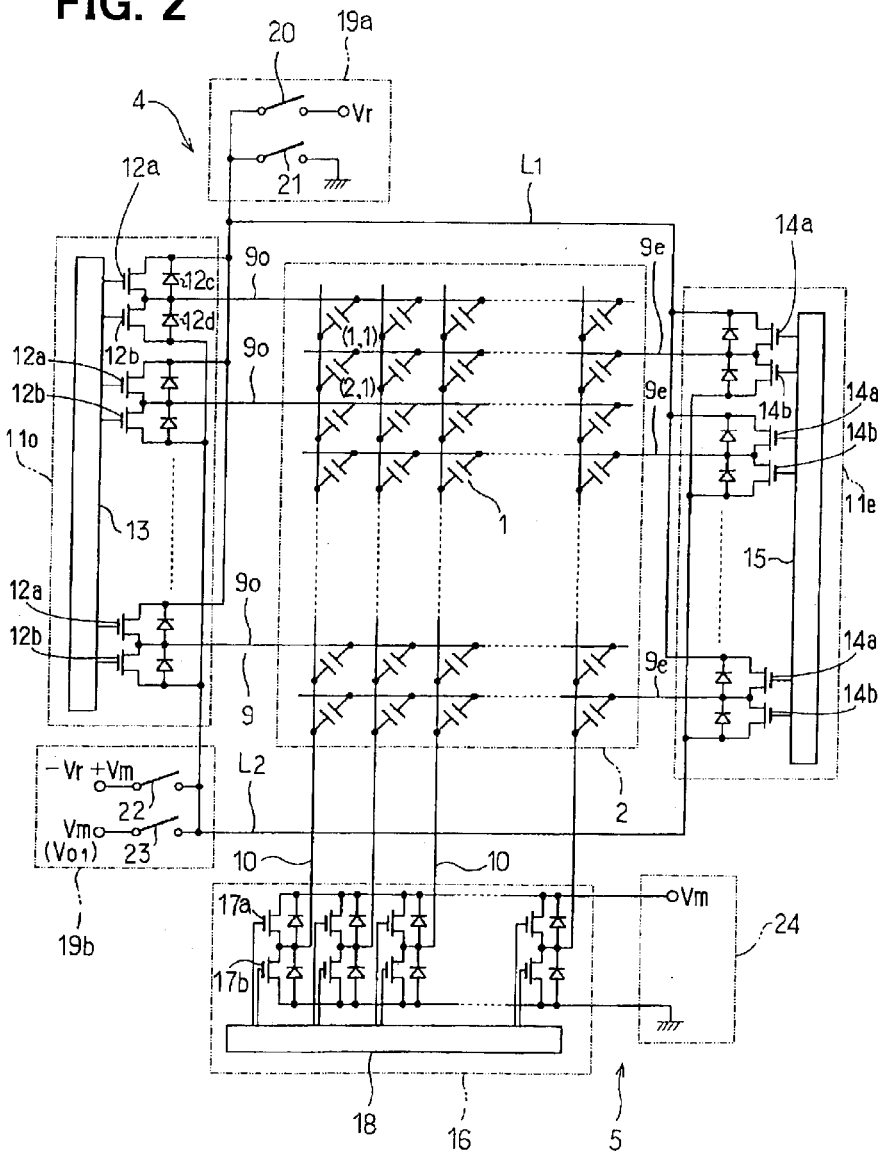
FIG. 2 shows a specific electric circuit of the EL display device according to the first embodiment.

FIG. 2 illustrates a specific electrical circuit of the EL display device 2, scanning electrode driver 4 and the data electrode driver 5. The EL display 2 is configured by a plurality of EL elements 1 arranged in matrix form. Specifically, a plurality of scanning electrodes 9 and a plurality of data electrodes 10 is respectively arranged in grid form to form a matrix. Each of the intersections formed by the scanning electrodes 9 and the data electrodes 10 corresponds to each of the EL elements 1, thereby forming a simple dot matrix type display configuration. In this configuration, the odd numbered scanning electrodes 9 are denoted by reference number 9*o*, while the even numbered scanning electrodes 9 are denoted by reference number 9*e*.

A scanning electrode driving circuit 11*o* applies a scanning voltage to the scanning electrodes 9*o*. The scanning electrode driving circuit 11*o* includes pairs of P channel FETs, such as the FET 12*a*, and N channel FETs, such as the FET 12*b,* each pair of which connects to each of the scanning electrodes 9*o,* and a driving circuit 13. The driving circuit 13 outputs signals to the P channel FETs 12*a* and the N channel FETS 12*b* to control voltages applied to the scanning electrodes 9*o*. Incidentally, a parasitic diode 12*c* or a parasitic diode 12*d* is formed in the P channel FETs 12*a* and the N channel FETs 12*b*, respectively, limiting the scanning electrodes 9*o* to a predetermined voltage.

A scanning electrode driving circuit 11*e* includes P channel FETs 14*a*, N channel FETs 14*b*, and a driving circuit 15 as the same configuration as the scanning electrode driving circuit 11*o* and applies a scanning voltage to the scanning electrodes 9*e*. A data electrode driving circuit 16 includes P channel FETs 17*a,* N channel FETs 17*b,* and a driving circuit 18 as the same configuration as the data electrode driving circuits 11*o,* 11*e* and applies a data voltage to the data electrodes 10.

The scanning electrode driving circuits 11*o,* 11*e* include scanning voltage application circuits 19*a,* 19*b*. The scanning voltage application circuit 19*a* includes switching elements 20, 21 by which a direct voltage (a data writing voltage) Vr corresponding to a driving voltage or a ground voltage is applied to a source side common line L1 of the P channel FETs 12*a*, 14*a* of the scanning electrode driving circuits 11*o,* 11*e*. The scanning voltage application circuit 19*b* includes switching elements 22, 23 by which a direct voltage −Vr+Vm corresponding to a driving voltage or a predetermined voltage Vm is applied to a source side common line L2 of the N channel FETs 12*b*, 14*b* of the scanning electrode driving circuits 11*o,* 11*e*.

The data electrode driving circuit 16 includes a data voltage application circuit 24. The data voltage application circuit 24 applies a direct voltage Vm to a source side common line of the P channel FETs 17*a* and a ground voltage to a source side common line of the N channel FETs 17*b*.

In the configuration as mentioned above, a portion including the scanning electrode driving circuits 11*o,* 11*e* and scanning voltage application circuits 19*a,* 19*b* corresponds to a scanning electrode driver 4. A portion including the data electrode driving circuit 16 and the data voltage application circuit 24 corresponds to a data electrode driver 5.

The scanning electrode driving circuit 11*o* also includes a pair of P channel FETs, such as the FET 12*a*, and N channel FETs, such as the FET 12*b*, each pair of which connects to each of the scanning electrodes 9*o,* and a driving circuit 13. The driving circuit 13 outputs signals to the P channel FETs 12*a* and the N channel FETs 12*b* to control voltages applied to the scanning electrodes 9*o*. Incidentally, a parasitic diode 12*c* or a parasitic diode 12*d* is formed in the P channel FETs 12*a* and the N channel FETs 12*b*, respectively, limiting the scanning electrodes 9*o* to a predetermined voltage.

Figure 3A:
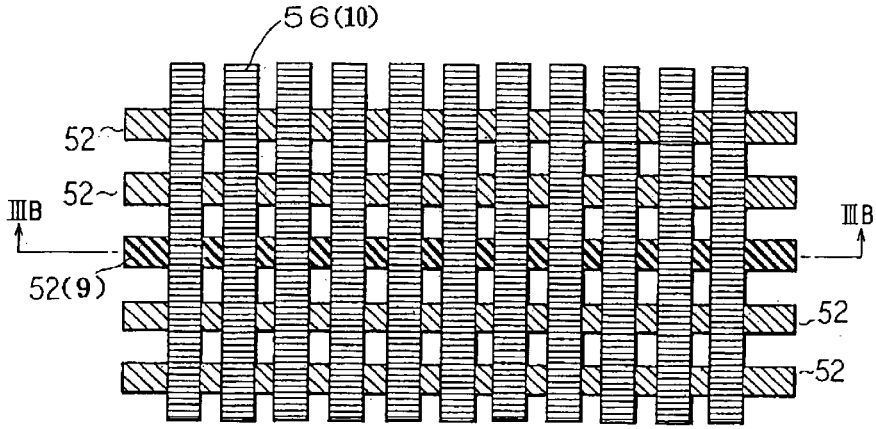
FIG. 3A shows a plan view of EL elements of the EL display according to the first embodiment.
Figure 3B:
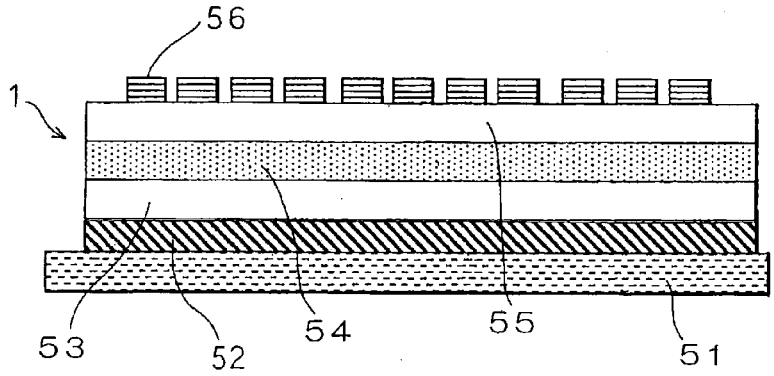
FIG. 3B shows a cross sectional view taken along line IIIB—IIIB of FIG. 3A.

A detailed configuration of the EL elements 1 will now be described with reference to FIGS. 3A and 3B. FIG. 3A shows a plan view of the EL elements 1, and FIG. 3B shows a cross sectional view taken along line IIIB—IIIB of FIG. 3A.

The EL elements 1 are configured on a glass substrate 51 on which first electrodes 52 (corresponding to the scanning electrodes 9), a first insulation 53, a phosphor 54, a second insulation 55, and second electrodes 56 (corresponding to the data electrodes 10) are respectively deposited. At least one side of the phosphor 54, that is, at least one of a group of the first electrodes 52 and the first insulation 53 and a group of the second insulation 55 and the second electrodes 56, is formed by transparent materials through which light emitted from the phosphor 54 can pass for display purposes. Specifically, each of the EL elements 1 corresponds to the phosphor 54 interposed between each one of the first electrodes 52 and each one of the second electrodes 56. Incidentally, the number of the EL elements 1 illustrated in FIGS. 3A and 3B is exemplary only, as the number of EL elements 1 can alternatively be more than shown in FIGS. 3A and 3B.

In the EL elements 1 as mentioned above, for example, the first electrodes 52 are made of Indium Tin Oxide (ITO). The first insulation 53 is formed by an $Al_2O_3/TiO_2$ layer in which $Al_2O_3$ layers and $TiO_2$ layers are alternatively disposed (hereinafter referred to as an ATO layer). The phosphor 54 is made of SrS:Ce. The second insulation 55 is also formed by an ATO layer. The second electrodes 56 are made of Al.

A method of manufacturing the EL electrodes 1 will now be described. The first electrodes 52 are formed on the glass substrate 1 by spattering an ITO layer that is transparent and that passes light. Regarding the ITO layer, a transparent ratio thereof is preferably set to 70% or more, and a thickness thereof is preferably set to 250 nm or more so that a sheet resistance thereof is set to 10Ω/□ or less because a lot of the EL elements 1 are formed relative to each one of the first electrodes 52.

The first insulation 53 is formed on the first electrodes 52 by forming an ATO layer by Atomic Layer Epitaxy (ALE). That is, an $Al_2O_3$ layer is formed with an aluminum trichloride ($AlCl_3$) gas corresponding to a material gas of Aluminum (Al) and $H_2O$ corresponding to a material gas of Oxygen (O) during an initial processing period. In ALE, the material gases of Al and O are alternatively supplied to a reaction chamber so that an atomic layer of $Al_2O_3$ is formed by each cycle. For example, the $AlCl_3$ gas is introduced into the reaction chamber for 1 minute with Argon (Ar) carrier gas, and the reaction chamber is then purged for discharging the $AlCl_3$ gas therefrom. Then, $H_2O$ is introduced into the reaction chamber for 1 minute with Argon (Ar) carrier gas, and the reaction chamber is then purged for discharging the $H_2O$ therefrom. Several cycles of above mentioned gas introduction and discharge are conducted to form the $Al_2O_3$ layer of a predetermined thickness.

An oxide titanium layer is formed on the $Al_2O_3$ layer with a titanium tetrachloride ($TiCl_4$) gas corresponding to a material gas of titanium (Ti) and $H_2O$ corresponding to a material gas of Oxygen (O) during the second processing period. That is, the $TiCl_4$ gas is introduced into the reaction chamber for 1 minute with Argon (Ar) carrier gas, and the reaction chamber is then purged for discharging the $TiCl_4$ gas therefrom. Then, $H_2O$ is introduced into the reaction chamber for 1 minute with Argon (Ar) carrier gas, and the reaction chamber is then purged for discharging $H_2O$ therefrom. Several cycles of the above mentioned gas introduction and gas discharge are conducted to form the oxide titanium layer of a predetermined thickness.

After several cycles of the first and second processing periods are conducted, the first insulation 53 formed by an $Al_2O_3/TiO_2$ layered configuration is completed. For example, $Al_2O_3$ layers and oxide titanium layers are respectively formed to 30 layers each having thickness of 5 nm. In the first insulation 53, the $Al_2O_3$ layer and the oxide titanium layer can alternatively be adapted as an undermost layer and an uppermost layer. Each of the $Al_2O_3$ layers and oxide titanium layers may preferably be formed to a thickness between 0.5 nm to 100 nm (more preferable, a thickness between 1 nm to 10 nm). Because the each of the $Al_2O_3$ layers and oxide titanium layers having a thickness of less than 0.5 nm does not act as insulation if formed on the atomic layer order, while layers having a thickness of more than 100 nm disable the first insulation 53 to increase withstanding voltage.

The phosphor 54 is formed on the first insulation 53 by depositing the SrS:Ce layer made of SrS being a primary material with Ce being a luminescent center material. That is, the phosphor 54 is formed by depositing pellets configured stoichiometrically and beaming thereon. In this case, sulfur elements such as hydrogen sulfide may preferably be involved in a chamber for forming the phosphor 54 during phosphor formation because a predetermined amount of sulfur may not be added in the phosphor 54. A thickness of the phosphor 54 can be selected based on characteristics of the EL display 2. However, it is preferably set to a thickness from 500 nm to 2000 nm. Portions through which light is emitted increase when the phosphor 54 is set to thickness less than 500 nm, while peeling or cracking thereof increases due to stress caused by strain from an excessive thickness when the phosphor 54 is set to thickness more than 2000 nm.

The second insulation 55 is then formed by ALE as was the first insulation 53 mentioned above. The second electrodes 56 are formed by spattering an Al layer, and the formation of the EL elements making up the EL display 2 is completed. The EL display 2 having the EL elements 1 with the SrS:Ce layer as the phosphor 54 emits blue light as a luminescent display color.

Incidentally, "Japan Display '86 pages 242–245" shows how a primary material or a luminescent center material, both of which may be used to form a phosphor, relate to an emission decay time of the phosphor. According to the publication, SrS is fit for the primary material. Therefore, Ce that is congenialed with SrS is used for the luminescent center material. Other material combinations may alternatively be adapted, but preparation of deposition pellets can be simplified when SrS:Ce combination is adapted.

Operation of the EL display 2 will now be described with reference to FIGS. 4, 5 and 6A–6C. The scanning electrode driver 4 and the data electrode driver 5 of the EL display 2 operate similarly to JP-A-H09-54566. In the present embodiment, the EL display 2 is driven by an additional operation.

Figure 4:
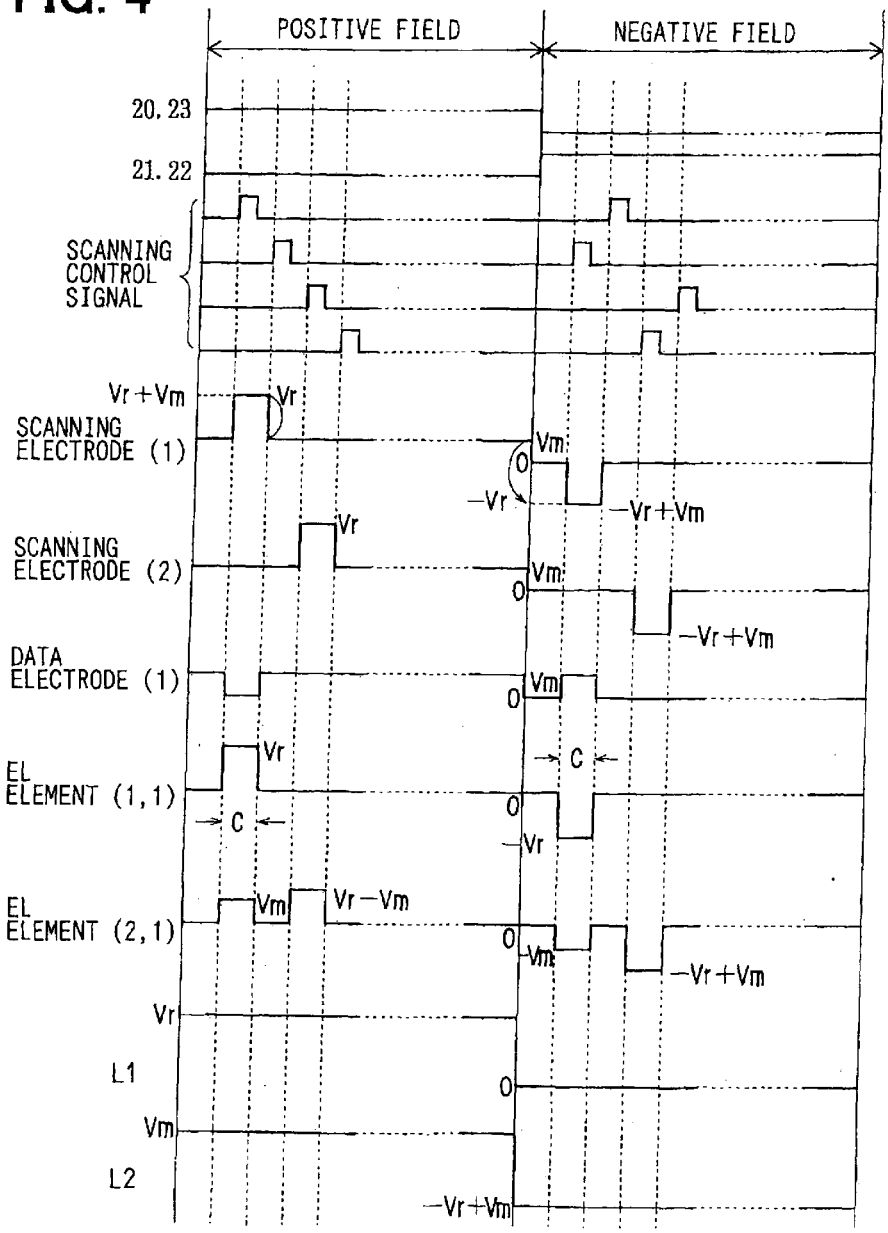
FIG. 4 shows a time chart of respective signals according to the first embodiment.

A basic operation of the EL display 2 is described with reference to FIG. 4. In order to emit light from the EL elements 1 of the EL display 2, it is necessary to apply an alternating pulse voltage between the scanning electrodes 9 and the data electrodes 10. Therefore, the EL display 2 is driven by a pulse voltage, which alternates every field, on each scanning line.

Specifically, in a positive field, after reference voltages of the scanning electrodes 9 and the data electrodes 10 are set to an offset voltage Vm of about 45V, a voltage (scanning voltage) Vr of about 210V that exceeds a predetermined threshold voltage for causing light to be emitted from the EL elements 1 is applied to some of the scanning electrodes 9. In this case, the scanning electrodes 9 to which the voltage Vr should not be applied is set to a floating state. A ground voltage (display voltage) is applied to some of the data electrodes 10 that are connected with the EL elements 1 from which light should be emitted. Accordingly, since the voltage Vr is applied to the scanning electrodes 9 corresponding to both sides of the EL elements 1, some of the EL elements 1 to which the ground voltage is applied emit light. On the other hand, the offset voltage Vm is continuously applied to others from the data electrodes 10 that are connected with the EL elements 1 from which light should not be emitted. Therefore, a voltage Vr−Vm is applied to both sides of the EL elements 1 to which the offset voltage Vm is applied, and that do not emit light, because the voltage Vr−Vm does not exceed the predetermined threshold voltage. Then, electrons charged in the EL elements 1 are discharged to return the EL elements 1 an initial state.

In a negative field, the EL display 2 is operated as the positive field, although a voltage opposite the voltages at the positive field is applied to both sides of the EL elements 1. In this case, the reference voltages of the scanning electrodes 9 and the data electrodes 10 are set to the ground voltage. The direct voltage −Vr+Vm is applied to the scanning electrodes 9. Regarding the data electrodes 10, voltages opposite to the voltages applied during the positive field are applied. That is, the offset voltage Vm is applied to some of the data electrodes 10 that are connected with the EL elements 1 from which light should be emitted. Accordingly, since a voltage −Vr is applied to the scanning electrodes 9 corresponding to both sides of the EL elements 1, the EL elements 1 to which the offset voltage Vm is applied emit light. On the other hand, the ground voltage is applied to others from the data electrodes 10 that are connected with the EL elements 1 of which light should not be emitted. Therefore, a voltage −Vr+Vm is continuously applied to both sides of the EL elements 1 to which the ground voltage is applied, and that do not emit light, because the voltage −Vr+Vm does not exceed the predetermined threshold voltage.

According to the positive and negative field operation mentioned above, a two-cycle display operation of the EL display 2 is completed. The two-cycle display operation is continuously repeated to operate the EL display 2.

Figure 5:
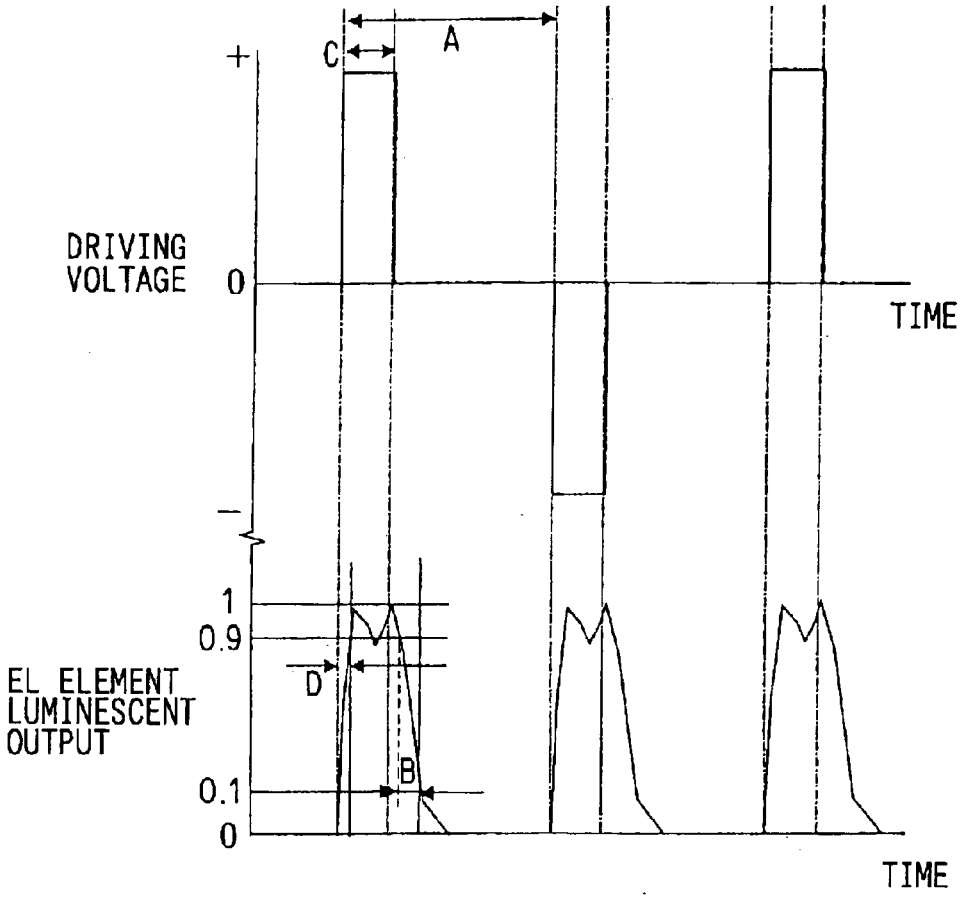
FIG. 5 shows a luminescent output of the EL elements with respect to a driving voltage according to the first embodiment.

Further, in the present embodiment, the following methodology is used for operating the EL display 2 based on the two-cycle display operation. This is because the phosphor 54 is made using SrS:Ce of which the emission decay time is very short, and therefore luminous power is too weak when the EL display 2 is operated by the two cycle display operation to illuminate the EL display 2 during intervals A of several milliseconds as shown in FIG. 5. That is, human visual perception is based on an amount of light integrated per time, and the amount of light integrated per time decreases due to short emission decay time. For example, the emission decay time of the EL elements 1 is on the order of about several $\mu$s, while that of an EL element of which a phosphor is made of ZnS:Mn is about 5 ms. The emission decay time corresponding to a light intensity of the EL element 1 decreases from "0.9" to "0.1" when a maximum value of the light intensity is defined as "1" (term B in FIG. 5). In FIG. 5, a vertical line is shown as a relative value because a size thereof changes due to a determination condition.

Figure 6A:
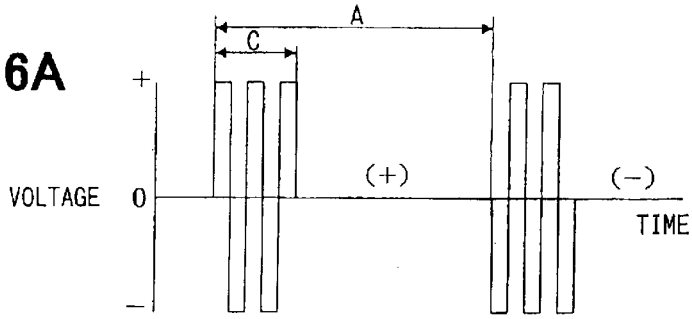
FIG. 6A shows a driving voltage pattern according to the first embodiment.

Specifically, the control unit 3 drives the EL elements 1 to emit light several times per scanning period (driving period) as shown in FIG. 6A. Each scanning period corresponds to an emission period at one cycle (one field or one scanning cycle) of which a voltage waveform thereof alternates in accordance with adjacent cycles. For example, in FIG. 5, the cycle corresponds to interval A, and the emission time at one cycle corresponds to interval C.

In other words, according to the present embodiment, by alternating the polarities of the voltage Vr to be applied to both sides of the EL elements 1, the scanning voltage (Vr, −Vr+Vm) is switched several times per scanning period (interval C). Therefore, when the scanning voltage as shown in FIG. 6A is applied to the EL elements 1, the EL elements 1 emit light several times corresponding to the number of times that the scanning voltage is applied. As a result, human visual perception is that light is continuously emitted during each scanning period. Actually, the EL elements 1 emit light two times during an emission rise time and during an emission decay time of the scanning voltage; FIG. 5 shows the continuous luminescent waveform of the EL elements 1.

According to the EL display 2 of the present embodiment, the control unit 3 drives the EL elements 1 to emit light several times per scanning period (driving period) as shown in FIG. 6A. Therefore, since the amount of light integrated over time increases, the EL display 2 obtains a requisite luminous power even if the El elements 1 of which the emission decay time is very short are used. The display quality of the EL display 2 therefore increases. Specifically, the manner of operation is preferable for the EL display configured by the EL elements 1 made of SrS:Ce because the emission decay time thereof is very short. Thus, the EL display 2 can emit blue light, and color variation of the EL display 2 increases.

In the present embodiment, for the reasons discussed below, a number of voltage applications of the scanning voltage is defined to be odd.

Figure 6B:
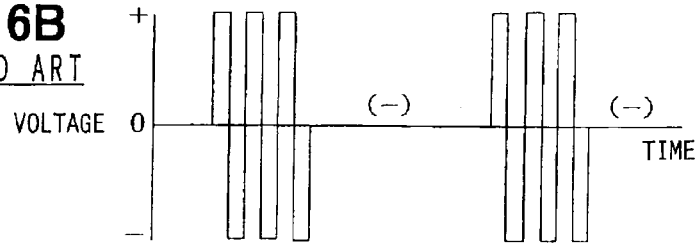
FIG. 6B RELATED ART
FIGS. 6B and 6C show driving voltage patterns according to a related art EL display.

FIG. 6B shows a virtual scanning voltage of which a number of voltage applications is defined to be even. As shown in FIG. 6B, when the number of the scanning voltage applications is defined to be even, a positive voltage is first applied to the EL elements 1. Then, the scanning voltage is repeatedly applied to the EL elements 1 as mentioned above before a negative voltage is finally applied to the EL elements 1.

An inside of the EL elements 1 maintains polarization when the scanning voltage application is stopped because the EL elements 1 have ferromagnetic material characteristics. However, since the negative voltage is applied to the EL elements 1 at the end of each scanning period when the number of the scanning voltage applications is defined to be even, polarities in the EL elements 1 while the scanning voltage is not applied to the EL elements 1 are imbalanced. Therefore, in order to stabilize characteristics of the EL elements 1, it is preferable to define the number of voltage applications of the scanning voltage to be odd.

Figure 6C:
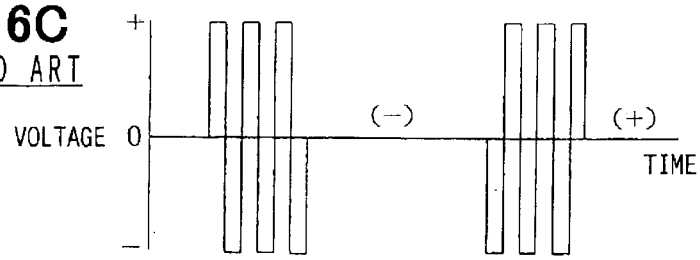
FIG. 6C RELATED ART

FIG. 6C shows a virtual scanning voltage waveform of which a number of voltage applications is defined to be even and of which polarities completely alternate every scanning cycle. In this case, a final scanning voltage of a preceding scanning cycle is of the same polarity as a first scanning voltage of a subsequent scanning cycle. Accordingly, the EL elements 1 are not driven by an alternating voltage. Since the EL elements 1 cannot emit light sufficiently without the alternating voltage, it is preferable to define the number of voltage applications of the scanning voltage to be odd.

To the contrary, according to a voltage waveform illustrated by FIG. 6A, polarities of the scanning voltage can be alternated every scanning cycle, and the polarity of the final scanning voltage of the preceding scanning cycle can be differentiated from that of the first scanning voltage of the subsequent scanning cycle. Therefore, a voltage waveform illustrated by FIG. 6A is used as the scanning voltage of the present embodiment.

An EL element of which an emission decay time matches a requisite luminous power can be used for the EL display 2. However, if the EL element is not be formed with ideal features, upon using above mentioned driving manner, the EL display 2 may obtain the requisite luminous power if the EL elements 1 of which the emission decay time is shorter than a requisite value can be manufactured as a product specification of the EL display 2.

More specifically, the EL elements 1 may be configured with the phosphor 54 of which the luminescent center material is Ce. Accordingly, the EL display 2 can obtain a luminous power higher than EL elements configured with a phosphor of which the luminescent center material is another type material. Further, because the primary material is SrS, Ce is compatible with SrS and therefore the EL elements 1 exhibit good light emission features.

As shown in FIG. 3B, the phosphor 54 is interposed between the first and second electrodes 52, 56 (the scanning electrodes 9 and the data electrodes 10) along with the first and second insulations 53, 55. Therefore, when the EL display 2 is formed to its requisite shape, it is easy for the EL elements 1 to emit light with uniform features. In addition, because the EL elements 1 are voltage driven film type EL elements, heat-related problems are unlikely to occur relative to current driven organic type EL elements. Therefore, the EL elements 1 of a voltage driven film type can be designed easier than the current driven organic type.

The data electrodes 10 are made of metal with low resistance. Therefore, the data electrodes 10 can be formed by narrow lines, and an emission rise response (term D in FIG. 5) can be fast because deformation of the signal waveform decreases.

According to the EL display 2 of the present embodiment, the number of voltage applications of the scanning voltage is defined to be odd. That is, a number of positive voltage applications is either higher or lower than a number of negative voltage applications. Therefore, the scanning voltage of which polarities completely alternate every scanning cycle is applied to both sides of the EL elements 1, and the polarity of the final scanning voltage of the preceding scanning cycle can be differentiated from that of the first scanning voltage of the subsequent scanning cycle. As a result, the EL elements 1 can emit light appropriately and obtain a long lifetime because the characteristics thereof can be prevented from changing.

(Second Embodiment)

In the second embodiment shown in FIGS. 7 to 12, a printer head of a luminescent printer is described according to another embodiment of the present invention. As shown in these figures, the printer head is configured with EL elements 1 of the type described in the first embodiment.

Figure 7:
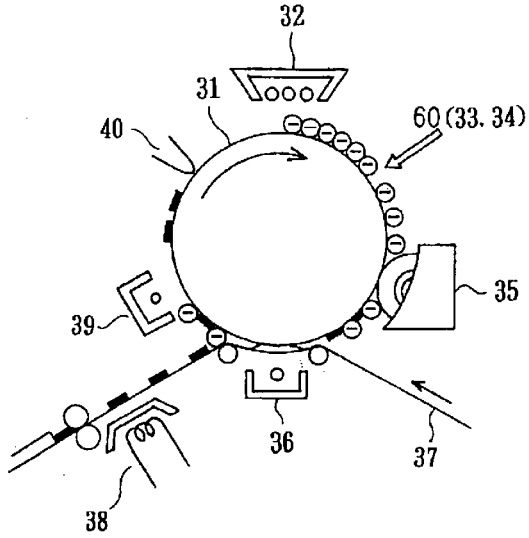
FIG. 7 shows main portions of a luminescent printer according to a second embodiment of the present invention.
Figure 8:
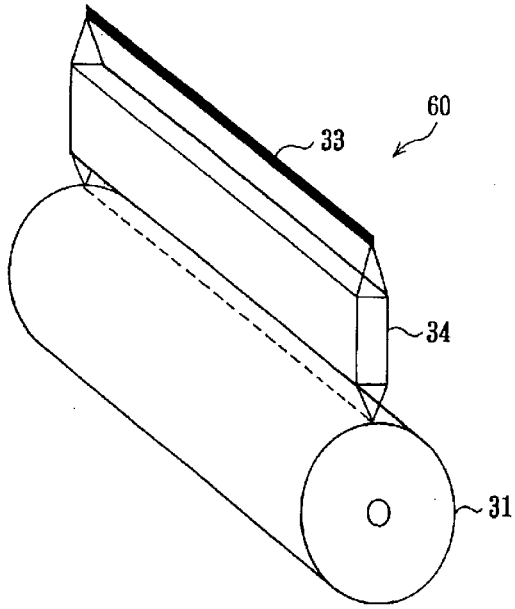
FIG. 8 shows a specific configuration of a printer head according to the second embodiment.

FIG. 7 is a schematic view showing main portions of the luminescent printer, and FIG. 8 is oblique perspective view of the printer head 60 and a light sensitive drum (a light sensitive portion) 31 illustrated in FIG. 7.

The light sensitive drum 31 is configured to rotate clockwise in FIG. 7. The light sensitive drum 31 is charged with negative charges through a charge portion 32, and then the surface thereof is exposed through an EL element array 33 and a Selfoc lens 34 shown in FIG. 8, which corresponds to the printer head 60, so as to print image data defined with respect to print objects. Therefore, in a part of the surface of the light sensitive drum 31 at which the printer head 60 exposed, a voltage potential thereof increases and an electrostatic latent image is formed. A development portion 35 prints toner on the part of the surface of the light sensitive drum 31 at which the negative charges are located.

An image formed by the toner printed on the surface of the light sensitive drum 31 is transferred on to paper 37 in FIG. 1 at a transferring portion 36, and then fixed on the paper 37 though a fixing portion 38 such as a heater. The light sensitive drum 31 may be discharged through a discharging portion 39 and is cleaned to remove the toner therefrom through a cleaning portion 40.

Specifically, the EL element array 33 is linearly arranged to function as a light source, and the Selfoc lens 34 is formed by a micro lens array. Therefore, light emitted from the EL element array 33 is concentrated by the Selfoc lens 34 and irradiated to the surface of the light sensitive drum 31.

Figure 9:
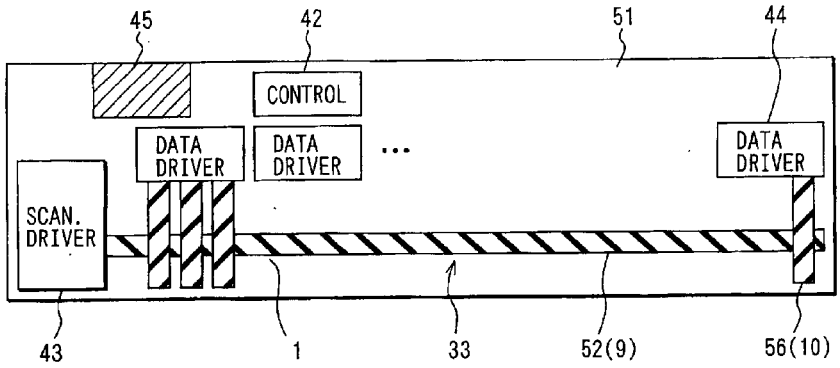
FIG. 9 shows an EL element array according to the second embodiment.

FIG. 9 shows the EL element array 33 configured by the EL elements 1 in the first embodiment. A glass substrate 51 acts not only as a substrate of the EL elements 1 but also as a substrate of the EL element array 33. A first electrode 52 (scanning electrode 9) is linearly formed because many of the EL elements 1 can be linearly arranged. A control circuit 42, a scanning electrode driver (driving circuit) 43, data electrode drivers (driving circuits) 44, and an external connection terminal 45 for electrically connecting to a control unit of a luminescent printer body are mounted on the glass substrate 51. The control circuit 42 drives the EL elements 1 in the manner described in connection with the first embodiment. Therefore, the EL elements 1 appropriately emit light.

The printer head 60 is driven with driving signals generated at appropriate times. The driving signals are defined as follows. Print speed required by the light printer is calculated. Incidentally, regarding an EL element made of ZnS:Mn mentioned in JP-A-H-05-221019, the print speed for printing on one page of A3 size paper with resolution of 600 dpi (dots per inch) is about one minute because an emission decay time thereof is about five seconds and maximum scanning frequency is 200 Hz. This printing speed is too slow for practical use.

In the present embodiment, the print speed is defined at a speed by which eight pages of A3 size paper can be printed within one minute with a resolution of 600 dpi, which is recognized as a high speed printer relative to standard printers. In this case, the emission decay time of the EL elements 1 defined based on the scanning cycle of the printer head 60 is calculated to be about 706 μs. Since the intervals A correspond to a paper transmission speed, the intervals A are defined as 706 μs. Further, in order to set resolution to 600 pdi, a width of the scanning electrode 9 and intervals disposed between each of the data electrodes 10 are defined to be 42 μm.

The interval C illustrated in FIG. 5 can be defined to be about 706 μs. However, it is preferable for the printer head 60 to be defined by the interval C to be 2 to 75% of the interval A, because contrast (luminous power) for the printing is insufficient when the interval C is defined to be less than 2% of the interval A, while an optical tolerance is insufficient when the interval C is defined to be more than 75%.

The scanning voltage is preferably defined to be 200V or more so that the scanning voltage exceeds a predetermined threshold voltage for emitting light from the EL elements 1 and the electrostatic latent image can be formed on the light sensitive drum 31.

The interval C for applying the scanning voltage is, for example, defined to be 100 μs corresponding to 14% of the interval A. In this case, if the emission decay time of the EL elements 1 (interval B) is defined to be too long, a plurality of elliptical dots overlaps as shown in FIG. 18B when the print speed increases because a shape of the light irradiated on the surface of the light sensitive drum 31 is extended. Therefore, to avoid an overlap of the elliptical dots, the interval B is defined to be less than A–C.

The emission rise time of the EL elements 1 is very short because the phosphor 54 is made of SrS:Ce. The emission rise time may be changed if a stoichiometric composition of the phosphor 54 changes but is defined to be 5 μs in the present embodiment.

Figure 10:
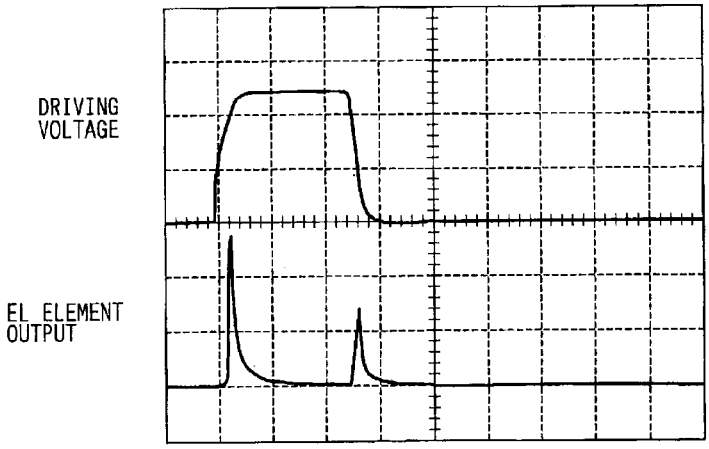
FIG. 10 RELATED ART
FIG. 10 shows a driving voltage waveform and a luminescent output of EL elements according to a related art EL element.

FIG. 10 shows a driving voltage waveform with a pulse width of 5 μs that is applied to the EL elements 1, and a voltage waveform observed by an oscilloscope to which an output of the EL elements 1 is transferred through a photoelectron multiplier. As shown in the voltage waveform corresponding to the output of the EL elements 1 of FIG. 10, the EL elements 1 emit light at each emission rise time and each emission decay time. However, when the emission rise time is 0.5 μs, the luminous power for forming the electrostatic latent image on the light sensitive drum 31 is insufficient.

Figure 11:
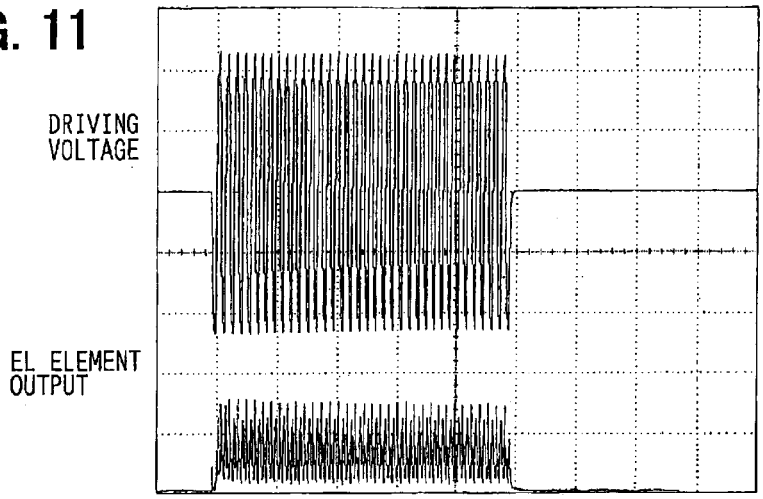
FIG. 11 shows a driving voltage waveform and a luminescent output of EL elements according to the second embodiment.

Therefore, in this embodiment, the EL elements 1 are repeatedly driven 71 times during the interval C (i.e., 100 μs) as shown in a driving voltage waveform illustrated in FIG. 11. Specifically, 36 applications of positive voltages and 35 applications of negative voltages to the EL elements 1 are performed. In this case, the pulse width of each of the positive and negative voltages is about 1.4 μs. Accordingly, the EL elements 1 emit light repeatedly during the interval C. As a result, a requisite luminous power for the printer head 60 can be obtained.

Figure 12:
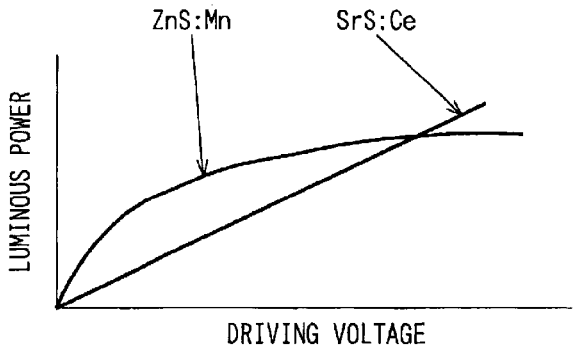
FIG. 12 shows relationships between a number of applications of the driving voltage with a pulse width of 1.4 $\mu$s applied to the EL elements and luminous power (output) of the EL elements.

FIG. 12 shows a relationship between a number of applications of the driving voltage with a pulse width of 1.4 μs applied to the EL elements 1 and a luminous power (output) of the EL elements 1. The luminous power is measured by a luminous power meter but is expressed with arbitrary units as a relative value. Regarding the EL elements 1, the luminous power linearly increases with respect to the number of applications of the driving voltage.

FIG. 12 also shows a relationship between a number of applications of the driving voltage with a pulse width of 1.4 μs applied to a relative EL element of which the phosphor is made of ZnS:Mn and a luminous power (output) of the EL element. In the EL element of which the phosphor is made of ZnS:Mn, since the emission decay time is long, a subsequent driving voltage is applied before the emission fall has passed when the driving voltage has a pulse width of 1.4 μs. Therefore, the luminous power is not increased with respect to the number of applications of the driving voltage. Incidentally, the luminous power of the EL element of which the phosphor is made of ZnS:Mn is larger than that of the EL elements 1 when the number of the applications of the driving voltage is low. This is because the luminous power of the EL element of which the phosphor is made of ZnS:Mn was measured within a long emission decay time.

The driving voltage applied to both sides of the EL elements 1 is preferably defined to at least a clamp voltage of the EL elements 1. The phosphor 54 of the EL elements 1 basically acts like an insulating material but acts like a resistor when a voltage applied to the EL elements 1 exceeds a predetermined voltage. When the voltage applied to the EL elements 1 does not exceed the predetermined voltage, three layers configured by the phosphor 54 and the first and second insulations 53, 55 adjacently disposed on the phosphor 54 act like an insulating material and therefore a capacitance of the EL elements 1 is defined based on the three layers. When the voltage applied to the EL elements 1 exceeds the predetermined voltage, the phosphor 54 acts like a resistor. Therefore, because two layers configured by the first and second insulations 53, 55 only act as an insulating material, the capacitance of the EL elements 1 increases, and electron charges in the EL elements 1 also increase. The predetermined voltage corresponds to the clamp voltage. By applying the driving voltage that equals the clamp voltage or more to the EL elements 1, a change of the luminous power with respect to a change of the driving voltage, and therefore non-uniformity of characteristics of the luminous power, can be small.

As a reference, a printer head 100 configured with LEDs is now described with reference to FIG. 13, which is a schematic view showing a configuration of the printer head 100. Each of a plurality of LED units 101 is configured by a plurality of LEDs 102 that are formed on a silicon substrate and connected to respective drivers 104. Each of the LEDs 102 is connected to one of the drivers 104 through wiring. The plurality of LED units 101 and the drivers 104 are arranged and mounted on a print substrate 103.

In this case, mount processing for mounting the plurality of LED units 101 and the drivers 104 and wiring processing for forming connections therebetween complicate the configuration of the printer head 100. Further, adjacent ones of the plurality of LED units 101 need to be adjusted to border characteristics thereof. Therefore, the EL element array 33 simplifies the configuration of the printer head 60 and obviates the need for adjustment of the border characteristics.

The LEDs generate heat when a current flows therein. Therefore, the print substrate 103 may bend due to the high heat, and optical system performance may deteriorate. Accordingly, the printer head 100 is configured to absorb the effects of the high heat. However, because the EL element array 33 is driven by a voltage and formed on the glass substrate 51, the glass substrate 51 hardly bends.

The EL element array 33 of the present embodiment is driven as mentioned above. However, because the control circuit 42 that controls the EL element array 33 is mounted on the glass substrate 51, the EL element array 33 can easily be exchanged as the LED array included in the printer head 100.

According to the second embodiment, the EL elements 1 are arranged at respective intersections of the scanning electrode 9 configured by one line and the data electrodes 10 to form a linear shape, thereby configuring the EL element array 33 of the light source of the luminescent printer. Therefore, the printer head 60 is capable of generating a requisite luminous power even if the El elements 1 of which the emission decay time is very short are used. With the EL element array 33, the print speed and the resolution of the luminescent printer increase.

(Third Embodiment)

Figure 13:
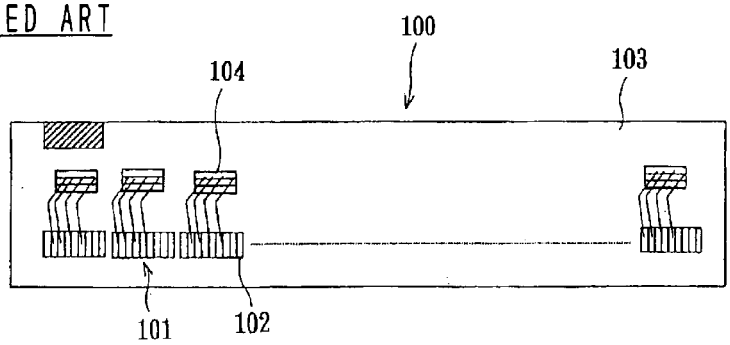
FIG. 13 RELATED ART
FIG. 13 shows a printer head configuration including LEDs according to a related art luminescent printer.
Figure 14:
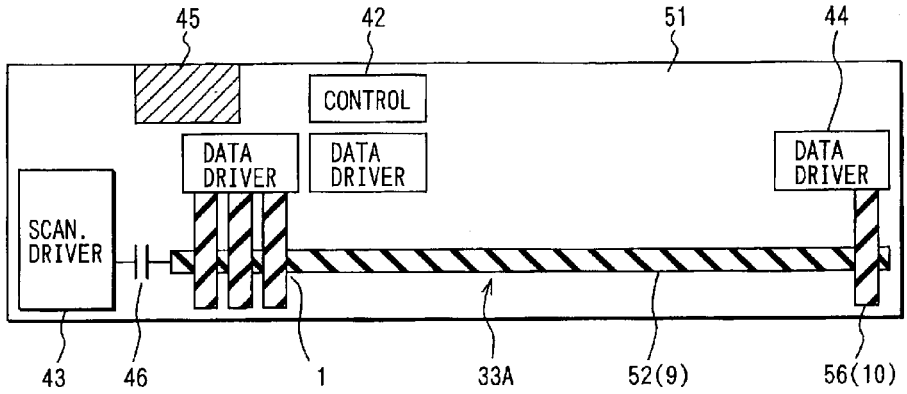
FIG. 14 shows main portions of the luminescent printer according to a third embodiment of the present invention.

In the third embodiment shown in FIGS. 13 and 14, a printer head of a luminescent printer according to a third embodiment of the present invention is described. As shown in FIGS. 13 and 14, in the third embodiment, the printer head having an EL element array 33 configured by EL elements 1 is modified with respect to that in the second embodiment. That is, a capacitor 46 is disposed between a scanning electrode driver 43 and data electrode drivers 44.

Figure 15:
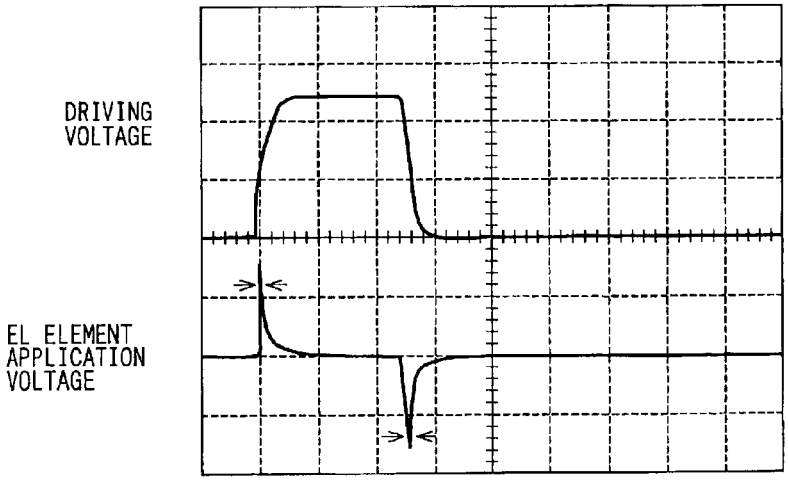
FIG. 15 shows a driving voltage waveform and an EL element application voltage according to the third embodiment.

According to the printer head of the third embodiment, the scanning electrode driver 43 and the data electrode drivers 44 are associated by the capacitor 46. Therefore, when a driving voltage waveform illustrated in FIG. 15 is applied to the EL elements 1, a voltage corresponding to a differential waveform with sharp peaks at each of rise and fall times of the driving voltage waveform is applied to the scanning electrode 9 as illustrated in FIG. 15. Since the EL elements 1 emit light at each of the rise and fall times of the voltage applied to the scanning electrode 9, the EL elements 1 emit light four times during each output of the driving voltage. Accordingly, an output frequency of the scanning voltage can be decreased.

(Fourth Embodiment)

Figure 16:
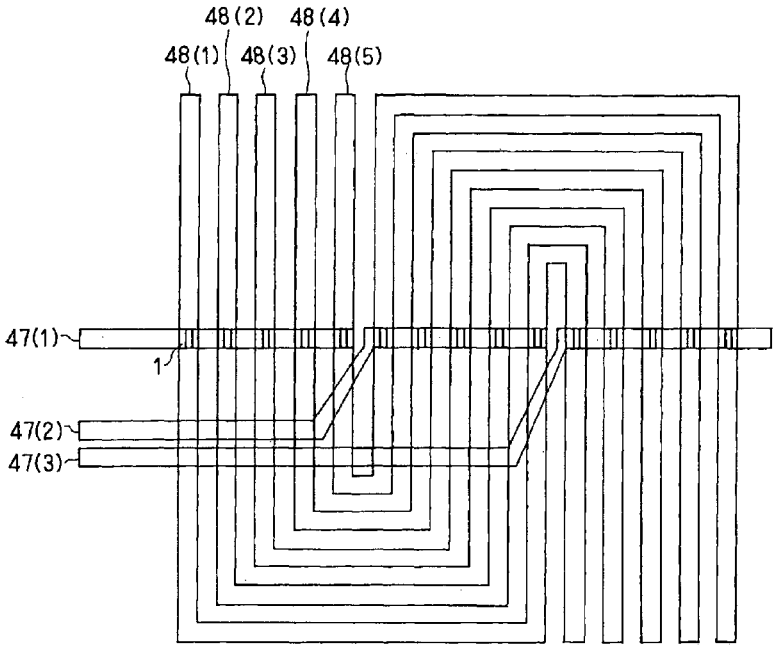
FIG. 16 shows an arrangement pattern of scanning electrodes and data electrodes according to a fourth embodiment of the present invention.
Figure 17A:
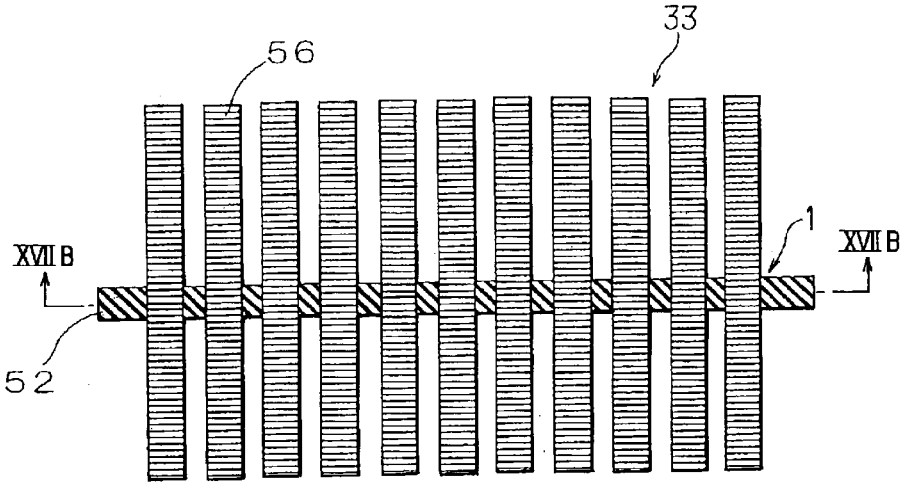
FIG. 17A shows a plan view of EL elements of the EL display according to a fifth embodiment of the present invention.
Figure 17B:
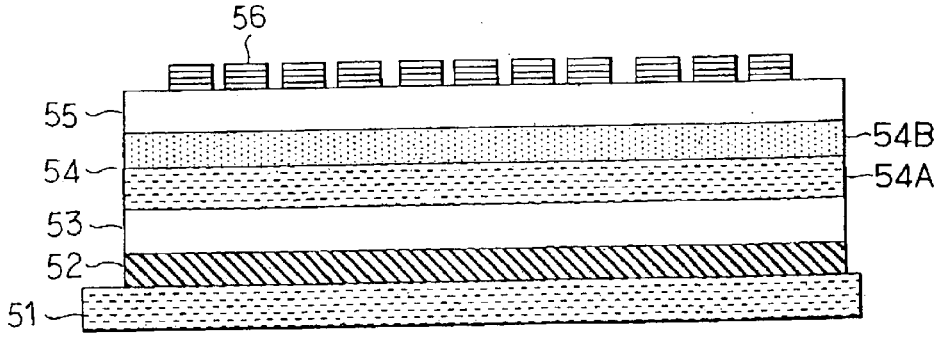
FIG. 17B shows a cross sectional view taken along line XVIIB—XVIIB of FIG. 17A according to the fifth embodiment.

In the fourth embodiment shown in FIG. 16, a printer head of a luminescent printer is described. As shown in FIG. 16, in the fourth embodiment, the printer head having an EL element array 33 configured by EL elements 1 is modified with respect to that in the second embodiment. Specifically, the configuration of the data electrodes 10 is modified with respect to that in the second embodiment.

In the second embodiment, when a number of the EL elements 1 is fifteen, one scanning electrode 9 and fifteen data electrodes 15 are arranged to be crossed with each other. In this case, the number of driver outputs for the scanning electrode 9 and the data electrodes 10 is 16 (=1+15).

In the fourth embodiment, as shown in FIG. 16, three (=m) scanning electrodes 47 and five (=n) data electrodes 48 are used for forming the EL elements 1. The five data electrodes 48 are respectively bent at 180° degree angles on upper and lower sides. The three scanning electrodes 47 (47(1)–47(3)) are respectively crossed with the five data electrodes 48 to form a linear configuration of the EL elements 1. A scanning voltage is simultaneously applied to the three scanning electrodes 47 by a control circuit. In this case, a number of driver outputs for the scanning electrodes 47 and the data electrodes 48 is 8 (=3+5).

According to the fourth embodiment, the driver outputs are simplified. Therefore, for example, when a driver source is necessary for each driver with respect to the driver outputs, the printer head can be downsized by increasing a number of the EL elements 1.

(Fifth Embodiment)

In the fifth embodiment shown in FIG. 17-20, a printer head of a luminescent printer is described. As shown in FIGS. 17A and 17B, in the fifth embodiment, the printer head having an EL element array 33 configured by EL elements 1 is modified with respect to that in the second embodiment. Specifically, a phosphor 54 is a two-layered configuration formed by a main phosphor 54A and a secondary phosphor 54B. The main phosphor 54A is made of the SrS:Ce that equals the phosphor 54 of the second embodiment. The secondary phosphor 54B is made of ZnS:Mn.

A method for manufacturing the EL electrodes 1 of the present embodiment is almost the same as the first embodiment. Accordingly, different portions of the manufacturing method of the EL electrodes 1 will be described.

First electrodes 52 and a first insulation 53 are formed on a glass substrate 51 in the same manner as the first embodiment. The first insulation 53 is made of an isolation material having a relative dielectric constant of at least 30 (more preferable at least 1000). When the relative dielectric constant is at least 1000, the EL elements 1 can obtain sufficient withstanding voltage. Because the thickness of the insulation 53 is uniform, when the insulation 53 is formed by a thick layer.

The phosphor 54 including the main phosphor 54A and the secondary phosphor 54B is formed on the first insulation 53. The main phosphor 54A is configured with a SrS:Ce layer made of SrS being a primary material and with Ce being a luminescent center material and formed in the same manner as the phosphor 54 of the first embodiment.

The secondary phosphor 54B is configured with ZnS:Mn layer made of ZnS being a primary material with Mn being a luminescent center material. The secondary phosphor 54B is formed by forming deposition pellets configured stoichiometrically and beaming thereon.

A thickness of the secondary phosphor 54B is approximately defined from 100 nm to 1000 nm. The thickness of secondary phosphor 54B is set to an appropriate value because it is one of the elements for defining a dynamic range of a requisite luminous power of the EL elements 1.

According to the main and secondary phosphors 54A, 54B, a manufacturing process thereof can be fixed. That is, because the secondary phosphor 54B prevents moisture ingress to the main phosphor 54A, corrosion of the main phosphor 54A made of SrS:Ce that is easily dissolved in water can be avoided. Accordingly, to remove moisture from the phosphor 54, it is preferable that respective manufacturing processes of the phosphor 54 are continuously performed in a vacuum atmosphere.

The second insulation 55 is then formed on the phosphor 54 in the same manner as the first insulation 53. The second insulation 55 is made of an isolation material having a relative dielectric constant of at least 30 (more preferable at least 1000) The second electrodes 56 are then formed in the same manner as the first embodiment.

In order to set a print resolution to 600 pdi, a width of a scanning electrode 9 (the first electrode 52) and intervals disposed between each of the data electrodes 10 (the second electrodes 56) are defined to be 42.3 $\mu$m. According to the EL elements 1 mentioned above, upon applying about 200V, the EL elements 1 emit light with sufficient intensity so that an electrostatic latent image can be formed on the light sensitive drum 31.

Incidentally, an arrangement of the EL element array 33, a control circuit and the like are the same in FIG. 9.

In the present embodiment, for the reason discussed below, the phosphor 54 is formed as a two-layered configuration with the main and secondary phosphors 54A, 54B.

The characteristics of the EL elements 1 used as a light source of the printer head are as follows.

(1) A high response corresponding to a print speed of the printer is required. The high response is defined by a time of driving signal period. The period of the driving signal is defined in the same manner as in the second embodiment so that elliptical dots do not overlap. That is, an interval C for applying the scanning voltage is, for example, defined to be 100 $\mu$s corresponding to 14% of the interval A (FIG. 6A).

The emission rise time of the EL elements 1 is very short because the phosphor 54 is made of SrS:Ce. The emission rise time may be changed if a stoichiometric composition of the phosphor 54 changes but is defined to be 5 $\mu$s in the present embodiment.

In order to obtain a characteristic of the time of the driving signal, it is preferable to use SrS as the primary material and Ce that is compatible0 with SrS as the luminescent center material. Other material combinations may alternatively be adapted, but preparation of deposition pellets can be simplified when a SrS:Ce combination is adapted. When other material combinations are adapted, colors of light emitted from the EL elements 1 change. However, as long as the emitted light is visible radiation, the electrostatic latent image can still be formed on the light sensitive drum 31.

Figure 20:
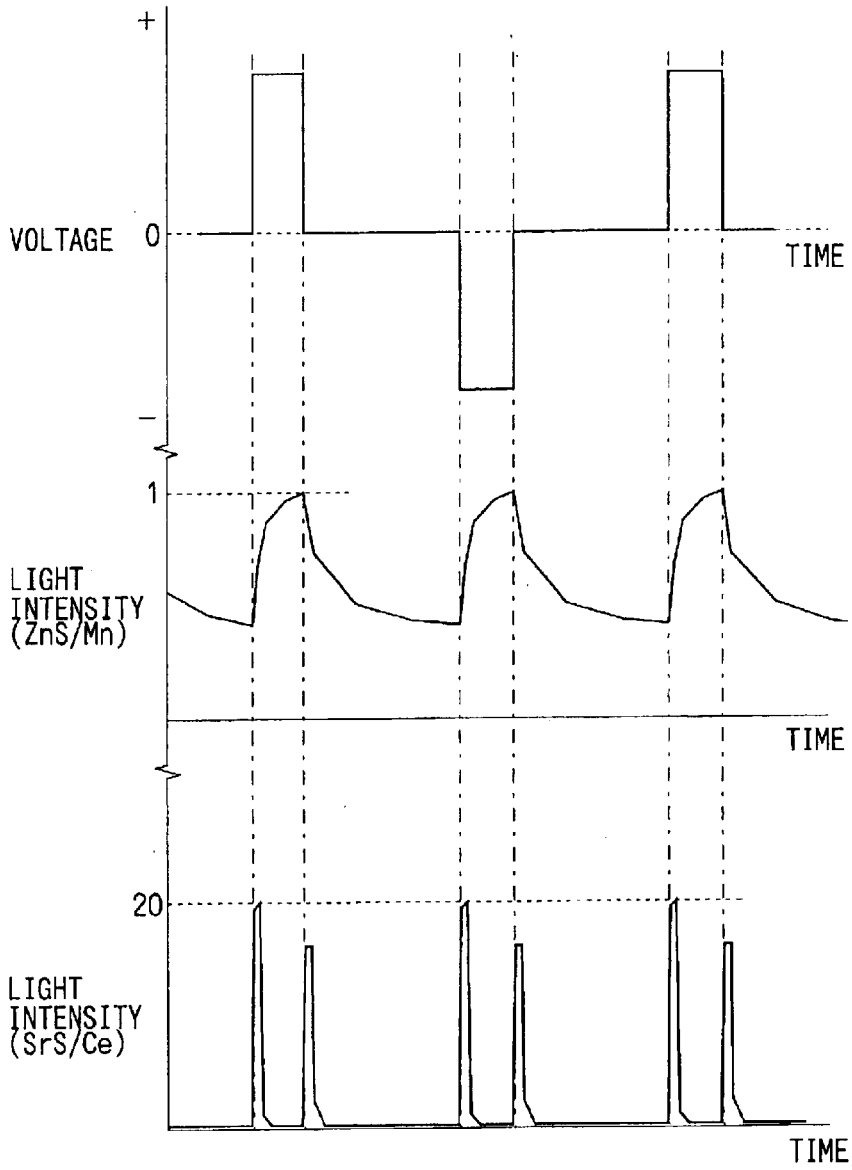
FIG. 20 shows light intensities of the EL elements according to the fifth embodiment.

(2) A requisite luminous power for forming the electrostatic latent image on the light sensitive drum 31 is required. The EL elements 1 emit light during each emission rise time and each emission decay time when a rectangular voltage is applied thereto, and the emission decay time is very short (FIG. 20). Therefore, when the interval C for applying the scanning voltage is defined to be 100 $\mu$m, the luminous power decreases and the requisite luminous power for forming the electrostatic latent image on the light sensitive drum 31 is not obtained if the rectangular voltage having a pulse width of 100 $\mu$m is simply applied to the EL elements 1. Incidentally, the characteristics of the main phosphor 54A mainly affect the luminous power because those of the secondary phosphor 54B hardly affects the luminous power.

Accordingly, a control circuit 42 (FIG. 9) drives the EL elements 1 in the manner mentioned in the first embodiment to emit light several times (e.g., 11 times) per scanning period (FIG. 6A). Therefore, the EL elements 1 emit light appropriately.

(3) In the dynamic range defined based on a withstanding voltage of the data electrode drivers 44, the EL elements 1 need to be operated to form a clear difference (contrast) between an illumination state in which the electrostatic latent image is formed on the light sensitive drum 31 and a non-illumination state in which the electrostatic latent image is not formed on the light sensitive drum 31.

Figure 18A:
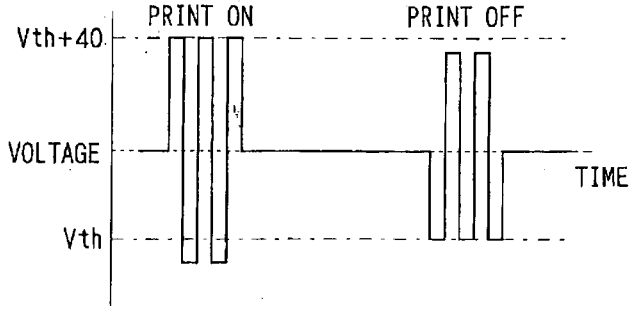
FIG. 18A shows a waveform of the driving voltage to be applied to both sides of the EL elements according to the fifth embodiment.
Figure 18B:
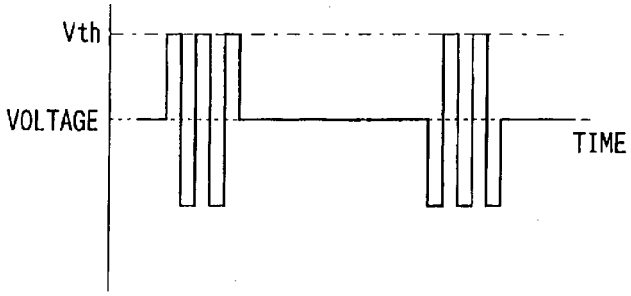
FIG. 18B shows a waveform of a scanning voltage to be applied to the scanning electrode according to the fifth embodiment.
Figure 18C:
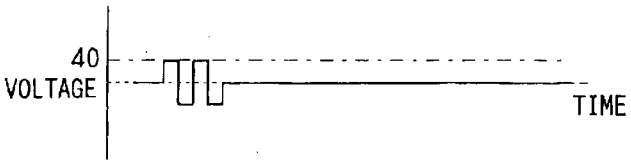
FIG. 18C shows a waveform of the data voltage to be applied to the data electrodes according to the fifth embodiment.
Figure 19:
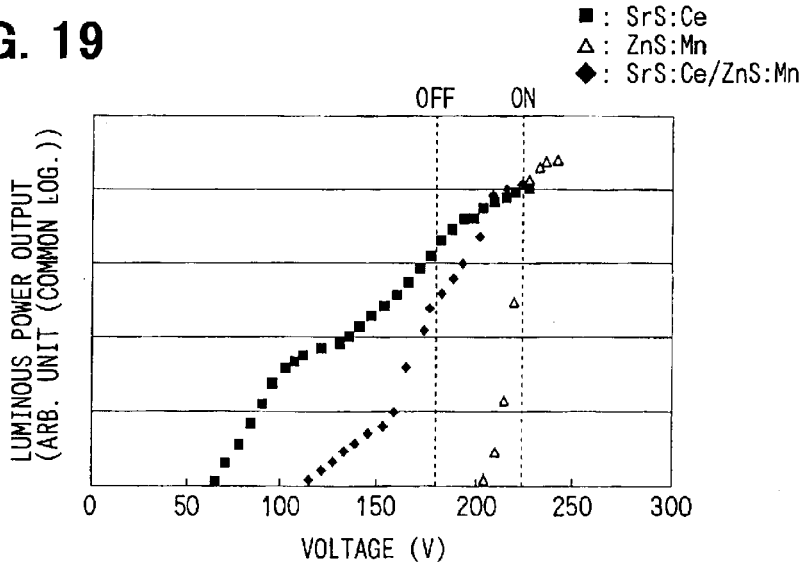
FIG. 19 shows a relationship between a driving voltage applied to both sides of the EL elements and a luminous power output according to the fifth embodiment.

FIG. 18A shows a waveform of the driving voltage to be applied to both sides of the EL elements 1. FIG. 18B shows a waveform of a scanning voltage to be applied to the scanning electrode 9 (52). FIG. 18C shows a waveform of the data voltage to be applied to the data electrodes 10 (56).

In order to illuminate the EL elements for printing, about 200V is required for applying to the EL elements 1. Further, the data electrode drivers 44 have to include a logic circuit that determines an output of the data voltage based on a display data signal from the control circuit 42, complicating the data electrode driver to withstand a high surge voltage. Accordingly, the withstanding voltage of the data electrode drivers 44 is defined to be within 40V to 60V. The scanning voltage is, as shown in FIG. 18B, set to 180V (Vth). The data voltage is, as shown in FIG. 18C, set to 40V.

Therefore, as shown in FIG. 18A, when EL elements 1 are set to ON, 220V (=180+40) is applied to both sides of the EL elements 1, and the EL elements 1 are set to an illumination state. When EL elements 1 are set to OFF, 180V is applied to both sides of the EL elements 1, and the EL elements 1 are set to a non-illumination state. In this case, since a voltage difference between the illumination state and the non-illumination state is only 40V, the EL elements 1 may emit light at the non-illumination state. However, when the EL elements 1 are used in the printer head 60, the electrostatic latent image is not formed on the light sensitive drum 31 even if the EL elements 1 emit light physically because the voltage difference is small. Therefore, the EL elements 1 can be practically and appropriately set to the non-illumination state if the electrostatic latent image is not formed on the light sensitive drum 31.

According to the present embodiment, the phosphor 54 is the two-layered configuration formed by the main phosphor 54A of which a dynamic range is short but an emission decay time is fast, and the secondary phosphor 54B of which a dynamic range is long but emission decay time is slow. As a result, the dynamic range of the phosphor 54 is defined to middle characteristics between the main and secondary phosphors 54A, 54B that can be utilized as the EL elements 1 of the printer head 60. Specifically, when a thickness ratio of the main phosphor 54A to the secondary phosphor 54B is set between 1:1 and 1:4, a relationship between a driving voltage applied to both sides of the EL elements 1 and luminous power illustrated in FIG. 19 can be obtained.

The effects of luminescent characteristics caused by the secondary phosphor 54B will now be described. Regarding the main phosphor 54A, when a plurality of pulse voltages is applied thereto every driving cycle, an emit start voltage by which the main phosphor 54A begins to emit light tends to decrease with respect to an emit start voltage when one pulse voltage is applied thereto. However, an emit start voltage by which the secondary phosphor 54B begins to emit light almost the same as an emit start voltage when one pulse voltage is applied thereto. Therefore, the secondary phosphor 54B is restricted to emit light based on a voltage difference between both of the emit start voltages.

FIG. 20 shows light intensities of an EL element of which a phosphor is made of ZnS:Mn and an EL element of which a phosphor is made of SrS:Ce when a rectangular pulse voltage is applied thereto. When a peak value of the light intensity of the EL element of which the phosphor is made of ZnS:Mn is defined as "1", that of the light intensity of the EL element of which the phosphor is made of SrS:Ce is defined as "20". Because the secondary phosphor 54B is made of ZnS:Mn, which has an associated luminous intensity weaker than that of SrS:Ce, the secondary phosphor 54B hardly affects the luminescent characteristics of the phosphor 54.

A wavelength of the light emitted from the EL element of which the phosphor is made of ZnS:Mn is 580 nm, and a wavelength of the light emitted from the EL element of which the phosphor is made of SrS:Ce is 480 nm. Further, the Selfoc lens 34 included in the printer head 60 includes chromatic aberration. Therefore, when the Selfoc lens 34 is adjusted so that the light of the EL element of which the phosphor is made of SrS:Ce corresponding to the light emitted from the main phosphor 54A converges on the surface of the light sensitive drum 31, the light of the EL element of which the phosphor is made of ZnS:Mn corresponding to the light emitted from the secondary phosphor 54B does not converge on the surface of the light sensitive drum 31 due to the chromatic aberration.

According to the present embodiment, the EL elements 1 formed by the main phosphor 54A of which the emission decay time is 5 $\mu$s and the secondary phosphor 54B made of ZnS:Mn, both of which are interposed between the scanning electrode 9 (52) and the data electrodes 10 (56) through the first and second insulations 53, 55. That is, the main phosphor 54A of which the emission decay time is short is selected so that the EL elements 1 can be adapted to an apparatus such as the printer head 60 in which a speedy emission response is required. In addition, the dynamic range can be set wide by forming not only the main phosphor 54A but also the secondary phosphor 54B when the withstanding voltage of the data electrode drivers 44 cannot be set to too large of a value.

The first and second insulations 53, 55 are made of isolation materials having specific inductive capacities of at least 30. Therefore, an electrostatic capacitance of the EL elements 1 increases, and a luminescent output of the EL elements 1 increases.

(Sixth Embodiment)

Figure 21:
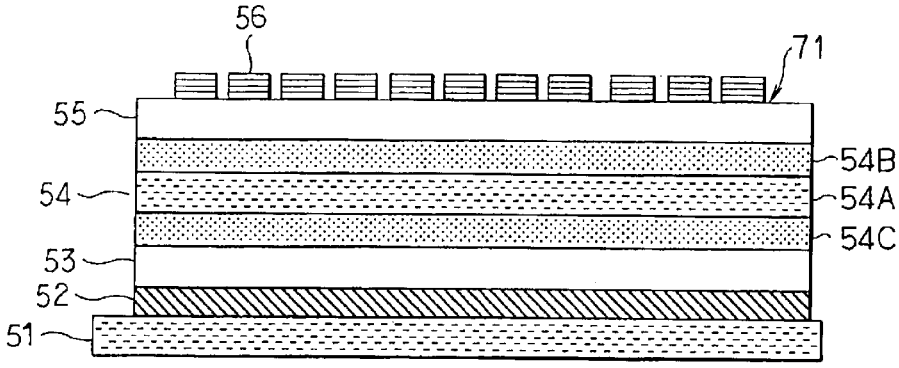
FIG. 21 shows a cross sectional view of EL elements according to a sixth embodiment of the present invention.

In the sixth embodiment shown in FIG. 21, a printer head of a luminescent printer is described. As shown in FIG. 21, in the sixth embodiment, the printer head having an EL element array configured by EL elements 71 is modified with respect to that in the fifth embodiment. That is, a main phosphor 54A is interposed between secondary phosphors 54B, 54C by forming the secondary phosphor 54C between the main phosphor 54A and the first insulation 53. The secondary phosphor 54C has the same thickness as that of the secondary phosphor 53B.

According to the present embodiment, the secondary phosphors 54B, 54C are disposed on and under the main phosphor 54A. Therefore, a manufacturing process of the EL elements 71 can be fixed. Further, because the secondary phosphors 54B, 54C are symmetrically disposed on the main phosphor 54A, a change in light characteristics of the EL elements 71 with respect to time decreases.

(Seventh Embodiment)

In the seventh embodiment, a printer head of a luminescent printer is described. The printer head 60 having an EL element array 33 configured by EL elements 1 has the same configuration as the second embodiment. Therefore, in the present embodiment, the printer head 60 is described with the same reference numbers as in the second embodiment (e.g., FIG. 9).

Figure 22:
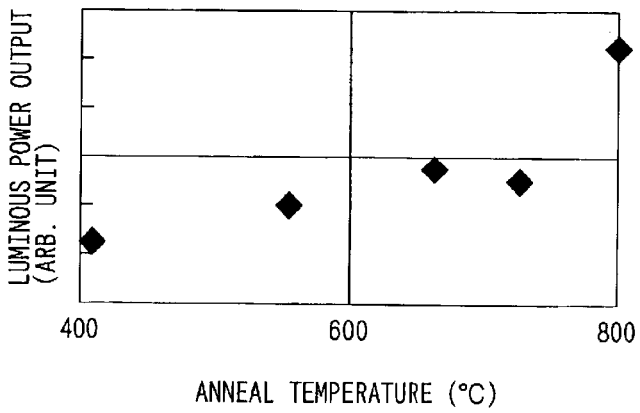
FIG. 22 shows a relationship between an anneal temperature and a luminous power output according to a seventh embodiment of the present invention.

In the seventh embodiment, a manufacturing process of the EL element array 33 is modified with respect to that in the second to sixth embodiments. That is, heat processing (anneal processing) is performed after a phosphor 54 is formed or after a second insulation 55 is formed. The heat processing is conducted for 0.5 to 6 hours at 800° C. Specifically, in the present embodiment, the heat processing is conducted for about 3 hours at 800° C. after the second insulation 55 is formed. Thus, as shown in FIG. 22, luminous power of the EL elements 1 greatly increases.

Figure 23A:
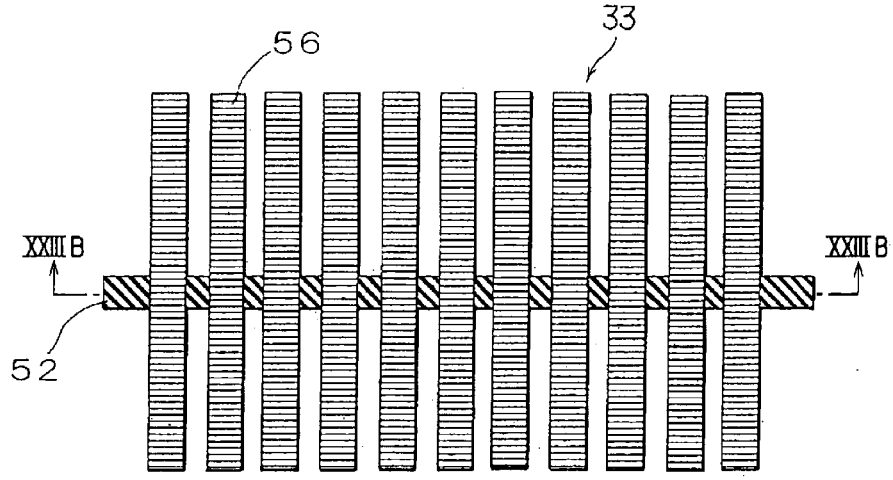
FIG. 23A shows a plan view of EL elements according to the seventh embodiment.
Figure 23B:
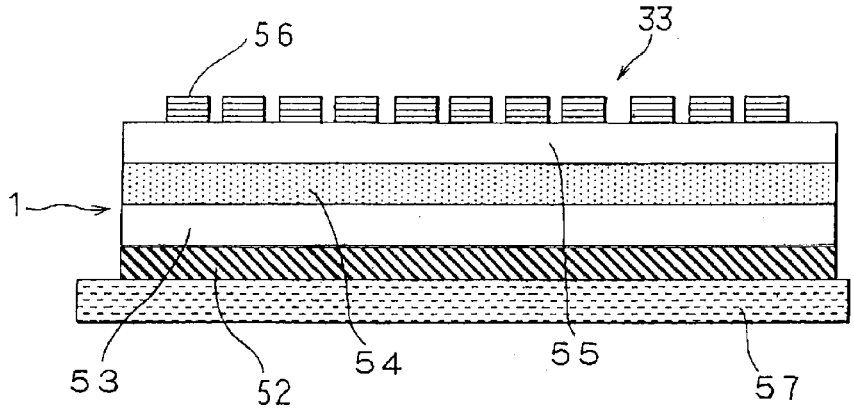
FIG. 23B shows a cross sectional view taken along line XXIIIB—XXIIIB of FIG. 23A.

FIG. 23A shows a plan view of the EL elements 1, and FIG. 23B shows a cross sectional view taken along line XXIIIB—XXIIIB of FIG. 23A. A ceramic substrate 57 is used for mounting the EL elements 1 and the like instead of the glass substrate 51 illustrated in FIG. 9. Other materials, e.g., aluminum substrate and quartz substrate, that withstand high temperature can alternatively be adapted as the substrate for mounting the EL elements 1.

According to the seventh embodiment, heat processing is performed after the second insulation 55 is formed. Thus, the luminous power of the EL elements 1 can increase. Further, the luminous power of the printer head 60 can increase when the EL elements 1 including the phosphor 54 through the heat processing are used in the printer head 60.

(Eighth Embodiment)

In the seventh embodiment, a printer head of a luminescent printer is described as one of the present invention. The printer head 60 having an EL element array 33 configured by EL elements 1 is the same configuration as in the second embodiment.

Figure 24:
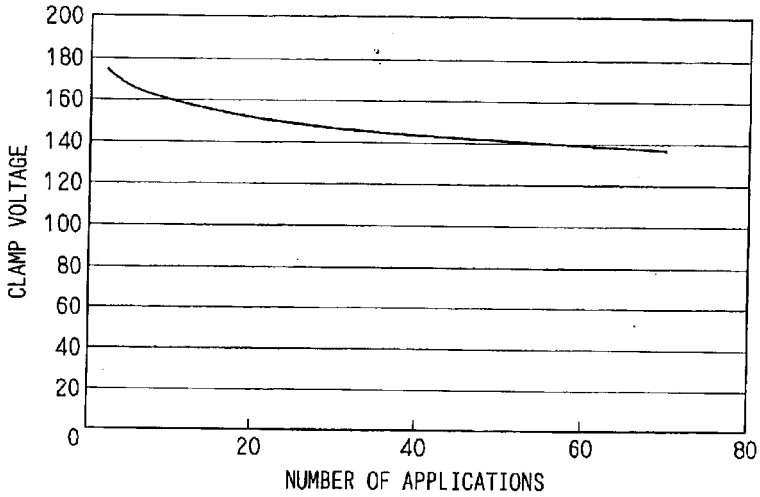
FIG. 24 shows a relationship between a number of applications of the driving voltage applied to EL elements and a clamp voltage of the EL elements according to an eighth embodiment of the present invention.
Figure 25:
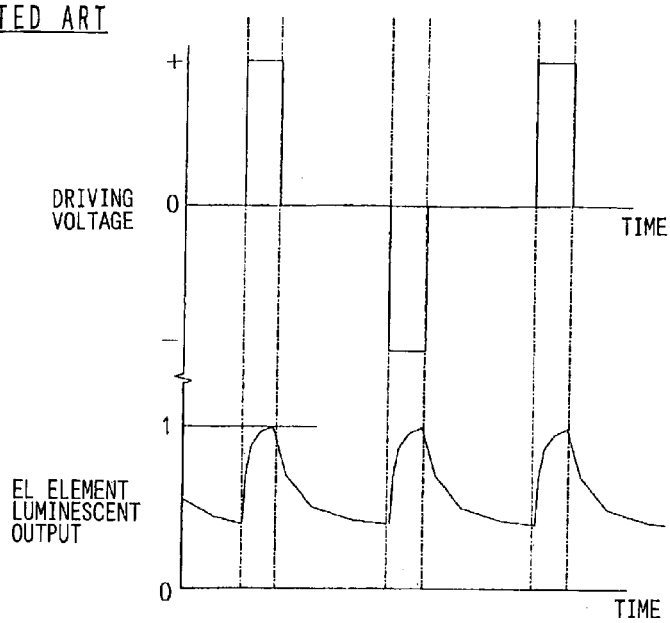
FIG. 25 RELATED ART
FIG. 25 shows a relationship between a driving voltage and luminous power (luminescent output) of EL elements according to a related art printer.
Figure 26A:
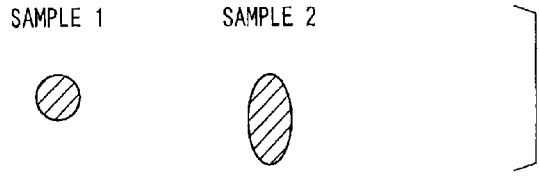
FIG. 26A RELATED ART
FIG. 26A shows a circular dot and an elliptical dot extended due to high printing speed according to a related art printer.
Figure 26B:
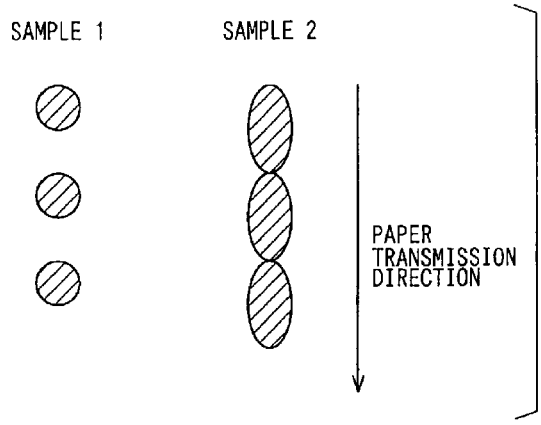
FIG. 26B RELATED ART
FIG. 26B shows dots when a plurality of circular dots and a plurality of elliptical dots are printed at intervals of one dot according to a related art printer.
Figure 27:
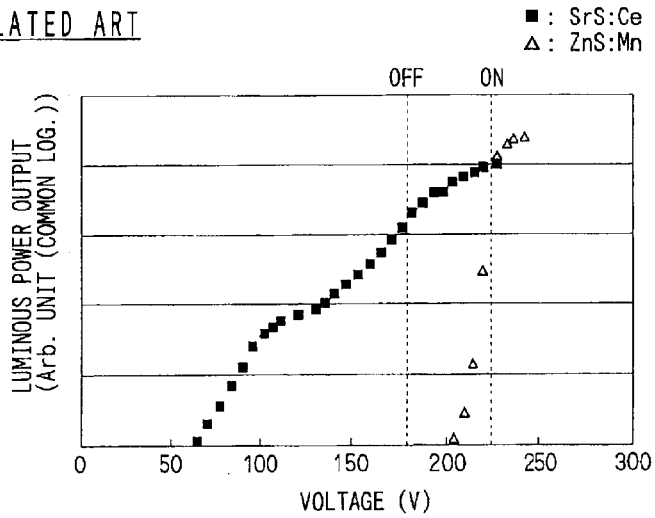
FIG. 27 RELATED ART
FIG. 27 shows a relationship between a driving voltage applied to both sides of the EL elements and a luminous power output according to a related art printer.

In the seventh embodiment, a driving voltage is modified with respect to that in the second to sixth embodiments. FIG. 24 shows a relationship between a number of applications of the driving voltage applied to the EL elements 1 and a clamp voltage of the EL elements 1. As shown in FIG. 24, the higher the number of applications of the driving voltage is, the lower the clamp voltage is. Accordingly, in the present embodiment, driving voltages output from a scanning driver 43 and data drivers 44 are changed based on the clamp voltage.

According to the present embodiment, driving voltages change appropriately with respect to the number of the applications of the driving voltage so as to be defined to a voltage slightly larger than the clamp voltage. Therefore, because the scanning driver 43 and the data drivers 44 prevent the EL elements 1 from applying an excessively high voltage, power consumption of the EL elements 1 decreases.

(Modifications)

In the first embodiment, the scanning cycle can be set to a half cycle when the scanning electrode driving circuits 11*e*, 11*o* are integrated into one circuit.

In the second to sixth embodiments, when the print speed as mentioned above can be performed, the emission decay time of the EL elements 1 can be set to 350 μs or less. For example, the fall speed of the EL elements 1 that can be recognized as a high speed printer relative to standard printers is about 700 μm. Accordingly, since the EL elements 1 emit light several times every scanning cycle, the requisite luminous power as the printer head 60 can be obtained even if the emission decay time is less than 700 μs.

If the print speed changes based on respective settings of luminescent printers, the emission decay time may alternatively be set to appropriate times with respect to the respective settings.

Further, the EL element array of the second to fourth embodiments may alternatively be adapted to the other apparatuses including an EL element array. In this case, the emission decay time may alternatively be set to at least 350 μs.

A number of applications of driving voltages of the EL elements 1 may alternatively be set to appropriate times based on the emission decay time and the setting of the printer head.

In the first embodiment, a three-level output circuit with a two-level push-pull circuit can alternatively be adapted as the scanning drier 4 to perform a positive scanning voltage, a negative scanning voltage and a ground level. In this case, it is unnecessary that the scanning voltage application circuits 19*a*, 19*b* switch the driving voltage.

In the first to sixth embodiments, Europium (Eu) can alternatively be adapted as the luminescent center material instead of Ce. Also, ZnS can alternatively be adapted as the primary material. The luminescent center material and the primary material can be changed when a requisite emission decay time can be obtained.

In the first to sixth embodiments, a number of voltage applications for the EL elements 1 can be defined to be even as illustrated in FIG. 6B when a change of characteristics of the EL elements 1 is allowable.

In the first to sixth embodiments, the driving voltage can alternatively be controlled based on the data voltage. For example, when polarities of the data voltage alternate continuously, the EL elements 1 are controlled as mentioned above.

In the second to sixth embodiments, the printer head can alternatively be adapted to copy machines and facsimile machines that use electrical photography technology.

In the first to sixth embodiments, current driven organic EL elements can alternatively be adapted as the EL elements 1, 71.

In the seventh embodiment, temperature and time of the heat processing can alternatively be changed based on a material of the phosphor 54, the requisite luminous power of the EL elements 1 or the like.

A high dielectric constant material, for example, PZT (Platinum-Zirconium-Titanium oxide), can alternatively be adapted as the first and second insulations 53, 55. In this case, because electrostatic capacitances of the first and second insulations 53, 55 increase, the luminous power of the EL elements 1 increases.

For example, luminance L [cd] of the EL elements 1 that is related to the luminous power can defined by the following formula, where "C" corresponds to capacitances [pF] of the first and second insulations 53, 55, "t" corresponds to a thickness [nm] of the phosphor 54, and "f" corresponds to a frequency [Hz] of the driving voltage.

$$L=0.085\times C\times e^{0.001168(t-884)}\times f^{0.888}$$

In the fifth to eighth embodiments, the scanning electrodes 47(1)–47(3) and the data electrodes 48(1)–48(5) illustrated in FIG. 16 can alternatively be adapted as the EL element array of the printer head 60.

While the above description is of the preferred embodiments of the present invention, it should be appreciated that the invention may be modified, altered, or varied without deviating from the scope and fair meaning of the following claims.

What is claimed is:

1. An EL device comprising;

a plurality of EL elements;

a driving circuit for applying a driving voltage to both sides of each of the plurality of EL elements; and a control unit for controlling the driving circuit to drive the plurality of EL elements to emit light;

wherein the control unit controls the driving circuit so that the plurality of EL elements emits light several times per driving cycle.

2. The EL device according to claim 1, wherein each of the plurality of EL elements includes a phosphor for emitting light, and the phosphor includes a luminescent center material made of one of Ce and Eu.

3. The EL device according to claim 2, wherein the phosphor includes a primary material made of SrS.

4. The EL device according to claim 1, wherein the driving circuit is configured so as to apply a first driving voltage and a second driving voltage, polarities of which are different from each other, to the both sides of the each of the plurality of EL elements, the control circuit controls the driving circuit so that the first driving voltage and the second driving voltage are alternately output to the both sides of the each of the plurality of EL elements within the driving cycle.

5. The EL device according to claim 4, wherein the control unit controls the driving circuit so that the first driving voltage and the second driving voltage are applied to the both sides of the each of the plurality of EL elements at different times.

6. The EL device according to claim 1, further comprising:

a plurality of scanning electrodes; and a plurality of data electrodes;

wherein the each of the plurality of EL elements is located at an intersection between the plurality of scanning electrodes and the plurality of data electrodes so that the plurality of EL elements is arranged in a matrix for forming an EL display.

7. The EL device according to claim 1, further comprising:

at least one scanning electrode; and a plurality of data electrodes;

wherein the each of the plurality of EL elements are located at an intersection between the at least one scanning electrode and the plurality of data electrodes so that the plurality of EL elements is linearly arranged for forming a printer head that is used as a light source of a luminescent printer.

8. The EL device according to claim 7, wherein the at least one scanning electrode comprises a plurality of linearly arranged scanning electrodes, each of which crosses each of the plurality of data electrodes once so that intersections thereof are linearly arranged.

9. The EL device according to claim 1, wherein the plurality of EL elements has an emission decay time of 350 μs or less.

10. The EL device according to claim 6, further comprising;

a first insulation and a second insulation;

wherein the plurality of EL elements are interposed between the plurality of scanning electrodes and the plurality of data electrodes through the first and second insulations.

11. The EL device according to claim 6, wherein one of the plurality of scanning electrodes and the plurality of data electrodes is made of metal.

12. The EL device according to claim 6, wherein the driving circuit includes a scanning electrode driving circuit for outputting a driving voltage to the plurality of scanning electrodes and a data electrode driving circuit for outputting a driving voltage to the plurality of data electrodes, the EL device further comprising a capacitor for coupling the scanning electrode driving circuit and the data electrode driving circuit.

13. The EL device according to claim 1, further comprising:

insulations;

wherein each of the plurality of EL elements includes a main phosphor having an emission decay time of 700 or less and a secondary phosphor made of ZnS:Mn, and the main phosphor and the secondary phosphor are interposed between the insulations.

14. The EL device according to claim 13, wherein the secondary phosphor includes two layers between which the main phosphor is interposed.

15. The EL device according to claim 13, wherein the insulation has a relative dielectric constant of at least 30.

16. The EL device according to claim 13, further comprising:

at least one of scanning electrodes; and a plurality of data electrodes;

wherein the each of the plurality of EL elements are located at intersection between the at least one of scanning electrodes and the plurality of data electrodes so that the plurality of EL elements is arranged in a line for forming a printer head that is used as a light source of a luminescent printer.

17. The EL device according to claim 13, wherein the driving circuit is configured to apply a first driving voltage and a second driving voltage of which polarities are different from each other to the both sides of the each of the plurality of EL elements, the control circuit controls the driving circuit so that the first driving voltage and the second driving voltage are alternately output to the both sides of the each of the plurality of EL elements within the driving cycle.

18. The EL device according to claim 17, wherein the control unit controls the driving circuit so that a total application number of the first driving voltage and the second driving voltage in the driving cycle are odd.

19. A driving device for driving a plurality of EL elements comprising;

a driving circuit for applying a driving voltage to both sides of each of the plurality of EL elements; and a control unit for controlling the driving circuit to drive the plurality of EL elements to emit light;

wherein the control unit controls the driving circuit so that the plurality of EL elements emits light several times per driving cycle.

20. The driving device according to claim 19, wherein the driving device drives the EL elements including a phosphor of which a main phosphor and a secondary phosphor are interposed between electrodes through insulations.

21. The driving device according to claim 19, wherein the driving circuit is configured to apply a first driving voltage and a second driving voltage of which polarities are different from each other to the both sides of the each of the plurality of EL elements, the control circuit controls the driving circuit so that the first driving voltage and the second driving voltage are alternately output to the both sides of the each of the plurality of EL elements within the driving cycle.

22. The EL device according to claim 21, wherein the control unit controls the driving circuit so that the first driving voltage and the second driving voltage are applied to the both sides of the each of the plurality of EL elements at different times.

23. A printer head comprising:

a plurality of linearly arranged EL elements each having a luminous power that rapidly decays and a characteristic emission decay time less than 700 μs.

24. The printer head according to claim 23, wherein each of the plurality of EL elements comprises an inorganic EL element interposed between electrodes through insulations.

25. The printer head according to claim 23, wherein the insulations are made of a material of which a relative dielectric constant is at least 1000.

26. The printer head according to claim 23, wherein the each of the plurality of EL elements includes a phosphor for emitting light, the phosphor includes a luminescent center material made of one of Ce and Eu.

27. The printer head according claim 26, wherein the phosphor includes a primary material made of SrS.

28. The printer head according to claim 26, wherein the phosphor is performed through heat processing.

29. The printer head according to claim 28, wherein the heat processing is performed at least 800° C.

30. The printer head according to claim 29, wherein the plurality of EL elements is mounted on a substrate made of a material that is capable of withstanding a temperature of at least 800° C.

31. The printer head according to claim 29, wherein the plurality of EL elements is mounted on one of a ceramic substrate, a quartz substrate and aluminum substrate.

32. The printer head according to claim 23, further comprising:

at least one scanning electrode; and a plurality of data electrodes;

wherein each of the plurality of EL elements is located at an intersection between the at least one scanning electrode and the plurality of data electrodes so that the plurality of EL elements is linearly arranged for forming a printer head that is used as a light source of a luminescent printer.

33. The printer head according to claim 32, wherein the at least one scanning electrode includes a plurality of linearly arranged scanning electrodes, each of the plurality of scanning electrodes crosses each of the plurality of data electrodes once so that intersections thereof are linearly arranged.

34. The printer head according to claim 32, further comprising:

a Selfoc lens for concentrating light emitted from the plurality of EL elements and forming an electrostatic latent image on a light sensitive portion.

35. A driving device for driving a printer head including a plurality of EL elements comprising;

a driving circuit for applying a driving voltage to both sides of each of the plurality of EL elements; and a control unit for controlling the driving circuit to drive the plurality of EL elements to emit light;

wherein the control unit controls the driving circuit so that the plurality of EL elements emits light several times per driving cycle.

36. The driving device according to claim 35, wherein the driving device drives the EL elements including a phosphor of which a main phosphor and a secondary phosphor are interposed between electrodes through insulations.

37. The driving device according to claim 35, wherein the driving circuit is configured so as to apply a first driving voltage and a second driving voltage of which polarities are different from each other to the both sides of the each of the plurality of EL elements, the control circuit controls the driving circuit so that the first driving voltage and the second driving voltage are alternately output to the both sides of the each of the plurality of EL elements within the driving cycle.

38. The driving device according to claim 37, wherein the control unit controls the driving circuit so that the first driving voltage and the second driving voltage are applied to the both sides of the each of the plurality of EL elements at different times.

39. The driving device according to claim 35, wherein the control unit controls the driving circuit so that the driving voltage exceeds a clamp voltage of the plurality of the EL elements.

40. The driving device according to claim 39, wherein the control unit controls the driving circuit so that the driving voltage changes based on a number of applications thereof.

41. A method for driving an EL device comprising:

applying a driving voltage to both sides of a plurality of EL elements by a control unit to cause each of the plurality of EL elements to emit light several times per driving cycle.

42. The method according to claim 41, wherein the applying includes alternately applying a first driving voltage and a second driving voltage of which polarities are different from each other to the both sides of the each of the plurality of EL elements within the driving cycle.

43. The method according to claim 42, wherein the applying includes applying the first driving voltage and the second driving voltage to the both sides of the each of the plurality of EL elements at different times.

44. The method according to claim 41, further comprising:

preparing a main phosphor having an emission decay time of 700 or less and a secondary phosphor made of ZnS:Mn as the plurality of EL elements, and insulations interposing the main and secondary phosphors.

45. The method according to claim 43, wherein the applying includes alternately applying a first driving voltage and a second driving voltage of which polarities are different from each other to the both sides of the each of the plurality of EL elements within the driving cycle.

46. The method according to claim 45, wherein the applying includes applying the first driving voltage and the second driving voltage to the both sides of the each of the plurality of EL elements at different times.

47. A method for driving a printer head including a plurality of EL elements as a light source comprising:

applying a driving voltage to both sides of a plurality of EL elements by a control unit to emit the plurality of EL elements several times per driving cycle.

48. The method according to claim 47, wherein the applying includes alternately applying a first driving voltage and a second driving voltage of which polarities are different from each other to the both sides of the each of the plurality of EL elements within the driving cycle.

49. The method according to claim 48, wherein the applying includes applying the first driving voltage and the second driving voltage to the both sides of the each of the plurality of EL elements at different times.

50. The method according to claim 47, further comprising:

preparing a main phosphor having an emission decay time of 700 or less and a secondary phosphor made of ZnS:Mn as the plurality of EL elements, and insulations interposing the main and secondary phosphors.

51. The method according to claim 49, wherein the applying includes alternately applying a first driving voltage and a second driving voltage of which polarities are different from each other to the both sides of the each of the plurality of EL elements within the driving cycle.

52. The method according to claim 51, wherein the applying includes applying the first driving voltage and the second driving voltage to the both sides of the each of the plurality of EL elements at different times.

53. The method according to claim 47, wherein the applying includes applying the driving voltage so that the driving voltage exceeds a clamp voltage of the plurality of the EL elements.

54. The driving device according to claim 53, wherein the applying includes changing the driving voltage based on a number of applications thereof.

55. A printer head comprising:

a plurality of linearly arranged EL elements each having a luminous power that rapidly decays and each comprising an inorganic EL element interposed between electrodes through insulation made of a material of which a relative dielectric constant is at least 1000.

56. The printer head according to claim 55, wherein each of the plurality of EL elements has a characteristic emission decay time less than 700 $\mu$m.

57. The printer head according to claim 55, wherein each of the plurality of EL elements comprises an inorganic EL element interposed between electrodes through insulations.

58. The printer head according to claim 55, wherein the each of the plurality of EL elements includes a phosphor for emitting light, the phosphor includes a luminescent center material made of one of Ce and Eu.

59. The printer head according to claim 58, wherein the phosphor includes a primary material made of SrS.

60. The printer head according to claim 58, wherein the phosphor is performed through heat processing.

61. The printer head according to claim 60, wherein the heat processing is performed at least 800° C.

62. The printer head according to claim 61, wherein the plurality of EL elements is mounted on a substrate made of a material that is capable of withstanding a temperature of at least 800° C.

63. The printer head according to claim 61, wherein the plurality of EL elements is mounted on one of a ceramic substrate, a quartz substrate and aluminum substrate.

64. The printer head according to claim 58, further comprising:

at least one scanning electrode; and a plurality of data electrodes;

wherein each of the plurality of EL elements is located at an intersection between the at least one scanning electrode and the plurality of data electrodes so that the plurality of EL elements is linearly arranged for forming a printer head that is used as a light source of a luminescent printer.

65. A printer head comprising:

a plurality of linearly arranged EL elements each having a luminous power that rapidly decays;

a plurality of data electrodes; and a plurality of linearly arranged scanning electrodes, each of the plurality of scanning electrodes crosses each of the plurality of data electrodes once so that respective intersections thereof are linearly arranged, wherein each of the plurality of EL elements is located at the respective intersections between the plurality of scanning electrodes and the plurality of data electrodes so that the plurality of EL elements is linearly arranged for forming a printer head that is used as a light source of a luminescent printer.

* * * * *